US006586689B2

(12) United States Patent
Kuriyama

(10) Patent No.: US 6,586,689 B2
(45) Date of Patent: Jul. 1, 2003

(54) MULTI-DIRECTION SWITCH

(75) Inventor: Michihiro Kuriyama, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 56 days.

(21) Appl. No.: 09/785,885

(22) Filed: Feb. 14, 2001

(65) Prior Publication Data

US 2001/0023816 A1 Sep. 27, 2001

(30) Foreign Application Priority Data

Feb. 15, 2000 (JP) ..... 2000-036851
Jul. 11, 2000 (JP) ..... 2000-210374

(51) Int. Cl.[7] ..... H01H 19/00
(52) U.S. Cl. ..... 200/6 A; 200/5 R
(58) Field of Search ..... 200/415 A, 6 A, 200/5 R, 5 E, 6 R, 17 R, 18, 6 C, 329, 330, 341, 175, 313–315, 517, 406

(56) References Cited

U.S. PATENT DOCUMENTS 5,689,095 A * 11/1997 Kawase ..... 200/5 R
6,262,381 B1 * 7/2001 Kikuchi et al. ..... 200/6 A
6,335,496 B1 * 1/2002 Miyashita ..... 200/5 R
6,344,620 B1 * 2/2002 Nakamura ..... 200/6 A
6,348,664 B2 * 2/2002 Kozuma ..... 200/6 A
6,359,243 B1 * 3/2002 Nakade et al. ..... 200/6 A

FOREIGN PATENT DOCUMENTS

JP 11331329 11/1999

* cited by examiner

*Primary Examiner*—Anh Mai
*Assistant Examiner*—Lisa Klaus
(74) *Attorney, Agent, or Firm*—David N. Lathrop, Esq.; Gallagher & Lathrop

(57) ABSTRACT

In a multi-direction switch which is provided with a central switch and peripheral switches arranged about it and in which a keytop (40) is pressed to actuate a desired one of the switches, arms (52) of a pusher (50) are fixed to the underside of the keytop (40) with a central plate portion (71) of a frame (70) held between the the underside of the keytop (40) and the base (51) of the pusher (50) to provide therebetween a gap (4G) in which the keytop (40) is pivotable relative to the frame (70).

26 Claims, 18 Drawing Sheets

MULTI-DIRECTION SWITCH

BACKGROUND OF THE INVENTION

The present invention relates to a multi-direction switch for use in an input operation part of a portable telephone or the like.

Among multi-direction switches of this kind is, for example, a four-direction switch with a center click. The four-direction switch has a total of five switch contacts disposed at the center and at four positions around (front-rear and right-left) and is designed to actuate the central switch contact by manual depression of the keytop at the center thereof and a desired one of the others (peripheral switch contacts) by tilting the keytop in the direction corresponding thereto.

FIG. 1A depicts the four-direction switch with a center click which is disclosed in, for example, Japanese Patent Application Laid-Open No. 11-331329. In this prior art example, a central movable contact 12 and peripheral movable contacts 13 are disposed above a printed wiring board 11 on which there are formed plural pairs of spaced apart but adjacent stationary contacts (not shown). Overlying the movable contacts 12 and 13 is a keytop 14.

The central movable contact 12 is made of a resilient metal sheet press-worked in the shape of a dome. When pressed at the top, the central movable contact 12 flips into contact with the pair of stationary contacts corresponding thereto, establishing electrical connections between them. As a result, the central switch is turned ON. The flipping action provides good tactile response with a click.

On the other hand, the peripheral movable contacts 13 are each formed, for instance, by a strip of sheet metal having its outturned both ends fixed to the printed wiring board 11 with the intermediate portion spaced a required distance away from the pair of stationary contacts in parallel face-to-face relationship therewith. When depressed, the intermediate portion is elastically deformed into contact with the pair of stationary contacts. The central and peripheral movable contacts 12 and 13 are secured to the printed wiring board 11 by pasting thereto a single-sided adhesive sheet 15 from above.

The keytop 14, which is received in an opening 19 of a housing 17, has a laterally directed peripheral flange 16 continuous with the lower edge thereof for engagement with an engagement portion of the housing 17 to prevent the keytop 14 from falling off.

On the underside of the keytop 14 there are provided a central press protrusion 21 corresponding to the central movable contact 12 and peripheral press protrusions 22 corresponding to the respective peripheral movable contacts 22. As depicted in FIG. 1A, when the keytop 14 is not pressed, the central press protrusion 21 and the central movable contact 12 are in resilient contact, by which the flange 16 is resiliently pressed against the engagement portion 18. The central press protrusion 21 downward from the bottom surface of the keytop 14 is higher the respective peripheral press protrusion 22.

In the conventional multi-direction switch of the above construction, the depression of the keytop 14 at the center thereof causes the central movable contact 12 to flip into contact with the underlying stationary contact pair, turning ON the central switch. At this time, since the peripheral press protrusions 22 is lower than the central protrusion 21, none of the peripheral movable contacts 13 contact the stationary contact pairs, that is, no peripheral switches turn ON.

However, when the keytop 14 is pressed at its marginal edge to turn ON a desired one of the peripheral switches, the keytop 14 tilts or pivots about the engagement portion 18 of the housing 17 on the side diametrically opposite the marginal edge of the keytop 14 being pressed. As a result, the peripheral movable contact 13 on the side of the marginal edge being depressed is pressed by the corresponding peripheral press protrusion 22 but, at the same time, the central movable contact 12 is also pressed by the central press protrusion 21, and if too much deformed, the central movable contact 12 will flip and hence turn ON the central switch.

This leads to unnecessary manipulation of the central switch and requires increased force for pressing the keytop 14 accordingly and generates a click feel, too, badly impairing the operating feel and hence giving rise to a problem in ease of use.

SUMMARY OF THE INVENTION

It is therefore an object of the present invention to provide a multi-direction switch that prevents the possibility of the central switch being turned ON simultaneously by the manual operation for actuating (turning ON) the peripheral switch, and hence has excellent usability.

According to the present invention, there is provided a multi-direction switch which is provided with a central switch and a plurality of peripheral switches arranged about said central switch and in which a desired one of said switches is actuated by pressing a keytop, said multi-direction switch comprising:

a printed wiring board having formed thereon a central stationary contact and a plurality of peripheral stationary contacts arranged circumferentially about said central stationary contact;

a dome-shaped central movable contact disposed above said central stationary contact in opposing relation thereto and constituting said central switch together with said central stationary contact;

peripheral movable contacts each disposed above one of said peripheral stationary contacts in opposing relation thereto and constituting one of said plurality of peripheral switches together with the corresponding one of said plurality of peripheral stationary contacts;

a frame having a central plate portion disposed above said central movable contact, a plurality of legs bent form the periphery of said central plate portion toward said printed wiring board, and a fulcrum portion provided on the underside of said central plate portion, said frame being fixed to said printed wiring board;

a keytop disposed above said frame;

a housing having an opening for receiving said keytop and fixed to said printed wiring board; and a pusher having a base opposite the underside of said keytop with said central plate portion of said frame sandwiched therebetween, a plurality of arms extended radially from said base and fixed to the underside of said keytop, an engagement portion formed in the top surface of said base centrally thereof for pivotable engagement with said fulcrum portion of said frame, and a central press protrusion provided on the underside of said base centrally thereof opposite said central movable contact;

wherein the top surface of said base of said pusher and the bottom surface of said keytop define therebetween a gap for receiving said central plate portion of said frame in a manner to permit pivotal movement of said keytop.

With the above arrangement, the keytop pivots about substantially the center of the keytop where the frame and the pusher engage, not about the marginal edge of the keytop diametrically opposite the pressed edge as in the prior art; therefore, the peripheral and central switches are not likely to turn ON at the same time.

In the above multi-direction switch, a peripheral press protrusion may be provided on the underside of each arms of the pusher or on the underside of the keytop in opposing relation to one of the peripheral movable contacts, or In the above multi-direction switch, a plurality of retaining pieces are protrusively provided on the inner peripheral surface of the opening of the housing, the plurality of legs of the frame are bent outwardly in L-letter form, and the tip ends of the plurality of legs of the frame are fixedly held between the plurality of retaining pieces and the printed wiring board.

Alternatively, there is held between the housing and the printed circuit board a mounting plate which has cut therethrough a slit centrally thereof for receiving the base of the pusher and has secured thereto the central plate portion of the frame across the slit by the plurality of legs of the frame. And the peripheral press protrusions provided on the underside of the keytop are disposed opposite the peripheral movable contacts through the slit of the mounting plate. This structure permits reduction of the thickness of the multi-direction switch.

Alternatively, there is held between the housing and the printed wiring board an elastic sheet which has an opening bored therethrough centrally thereof for receiving the pusher and an annular ridge formed along the marginal edge of the opening and fitted in an annular groove cut in the underside of the keytop. This structure prevents the intrusion of foreign substances into the pivotal mechanism.

Alternatively, there are provided a mounting plate which has an annular portion and a plurality of frame support protrusions protruding from the inner marginal edge of the annular portion toward the center thereof for supporting the base of the frame disposed at the center of the mounting plate with the plurality of legs of the frame fixed to the plurality of frame support protrusions, and a double-sided adhesive sheet having its central portion cut out for bonding the annular portion of the mounting plate to the printed wiring board, the peripheral press protrusions of the keytop and the pusher lying in the cut-out area of the double-sided adhesive sheet. This structure allows ease in assembling the multi-direction switch.

DETAILED DESCRIPTION OF THE PREFERRED EMBODIMENTS

First Embodiment

Figure 2:
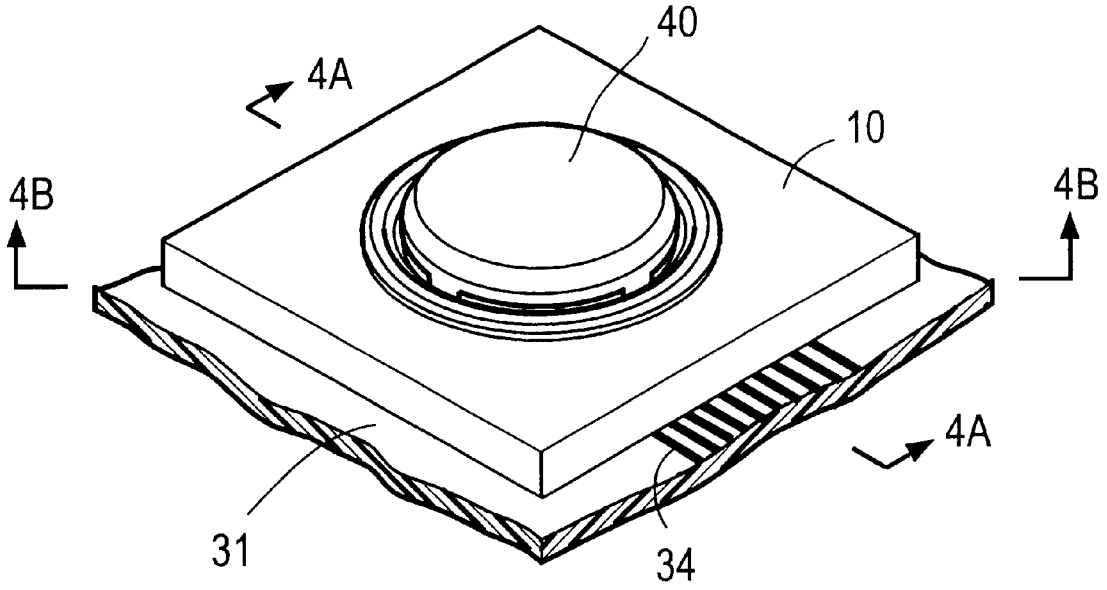
FIG. 2 is a perspective view of a multi-direction switch according to a first embodiment of the present invention.
Figure 3:
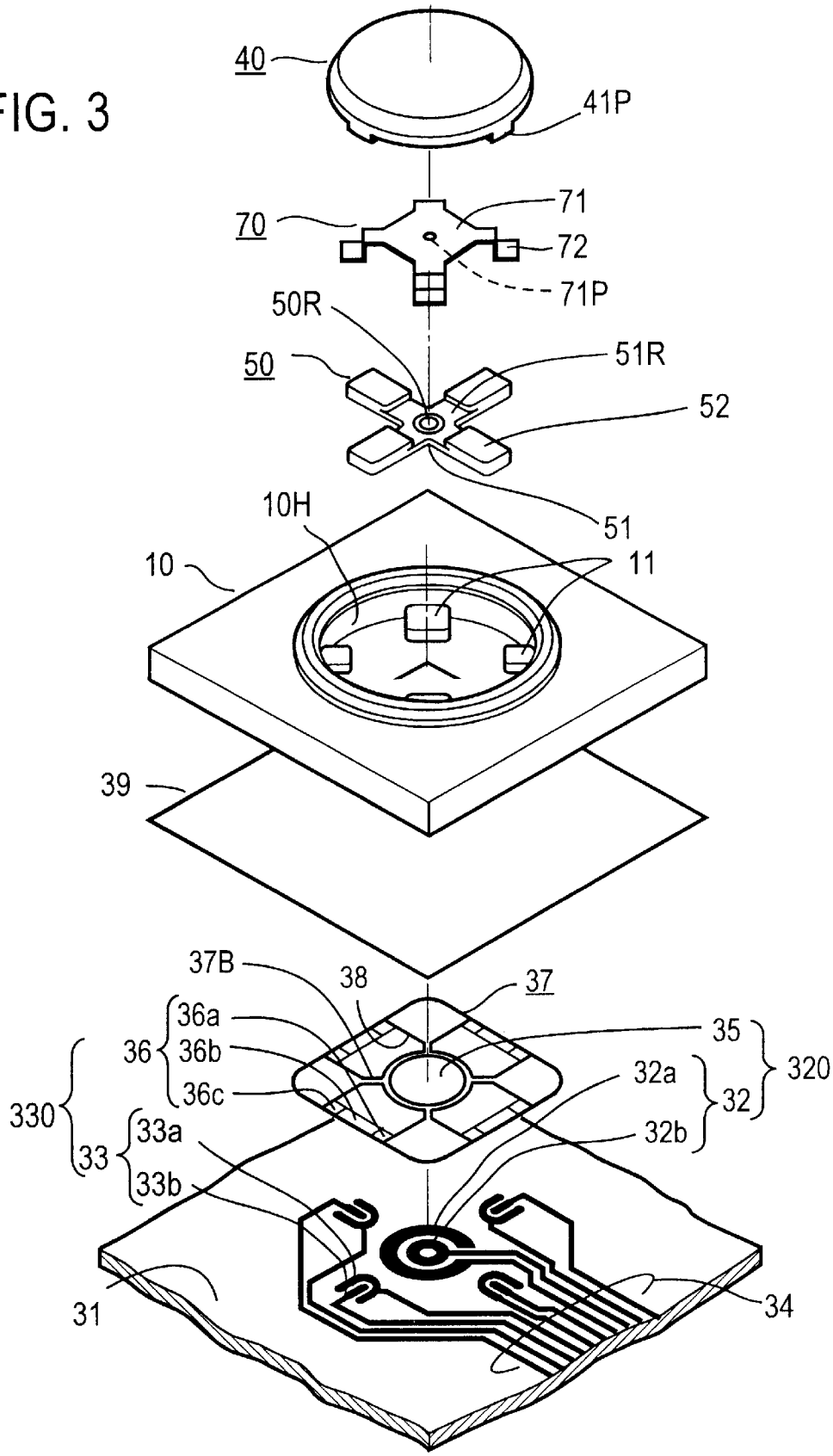
FIG. 3 is an exploded perspective view of the multi-direction switch shown in FIG. 2.
Figure 4A:
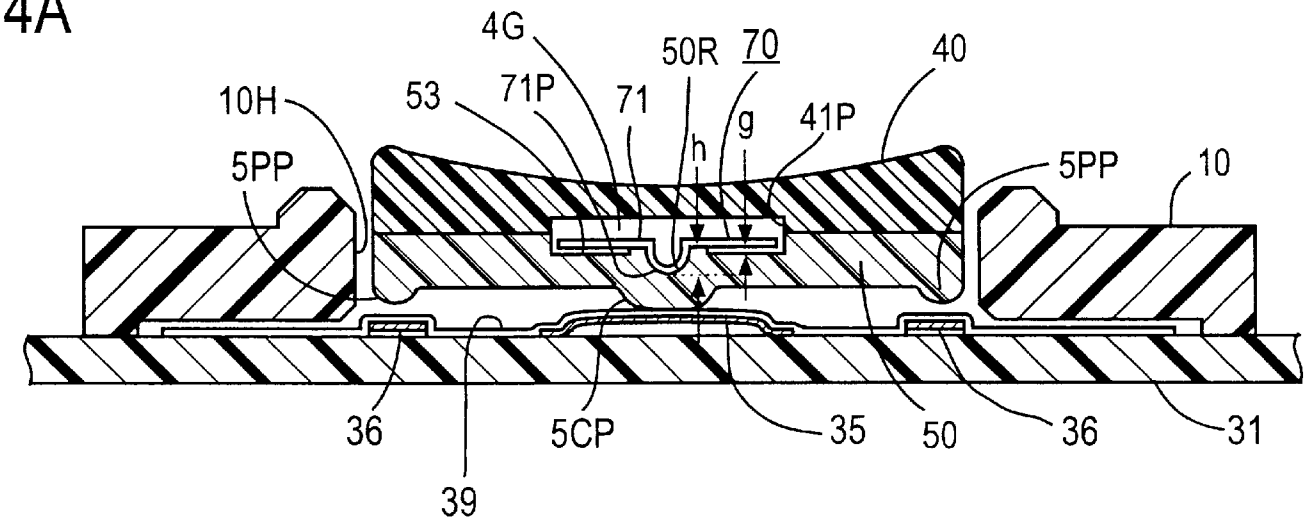
FIG. 4A is a sectional view taken along the line 4A—4A in FIG. 2.
Figure 4B:
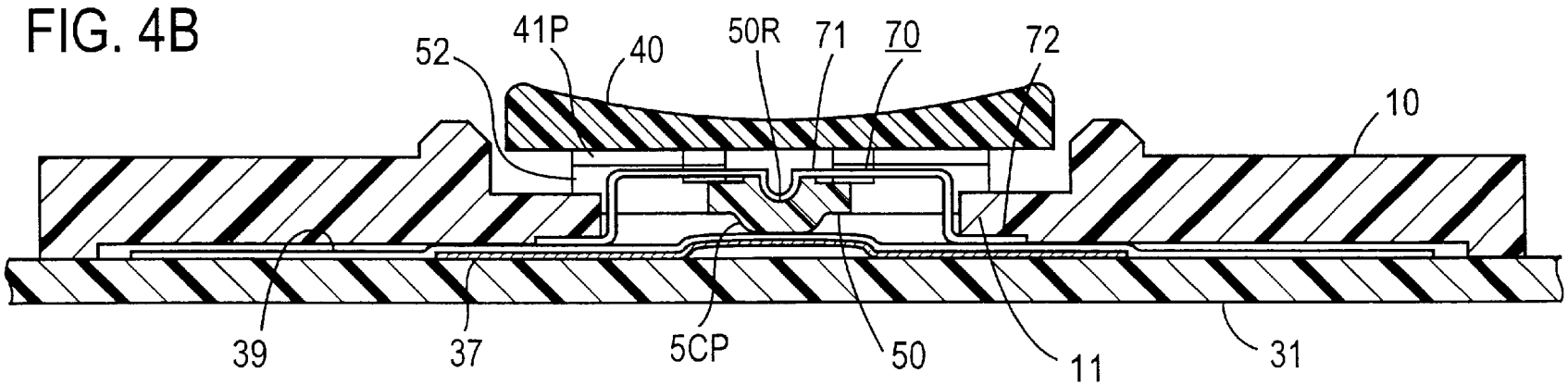
FIG. 4B is a sectional view taken along the line 4B—4B in FIG. 2.
Figure 5A:
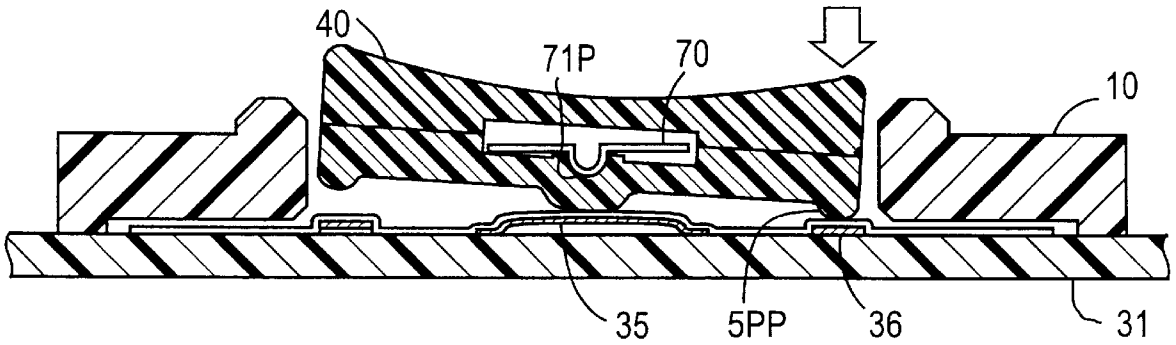
FIG. 5A is a sectional view taken along the line 4A—4A in FIG. 2 for explaining the operation of the first embodiment.
Figure 5B:
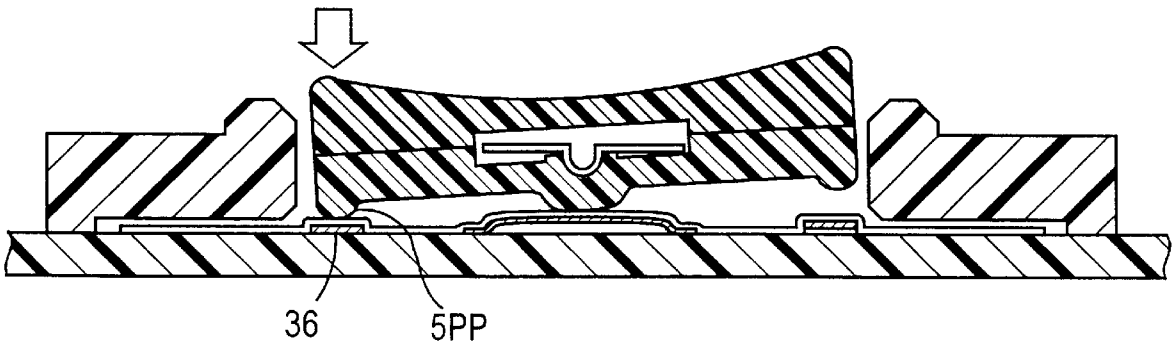
FIG. 5B is a sectional view taken along the line 4A—4A in FIG. 2 for explaining the operation of the first embodiment.
Figure 5C:
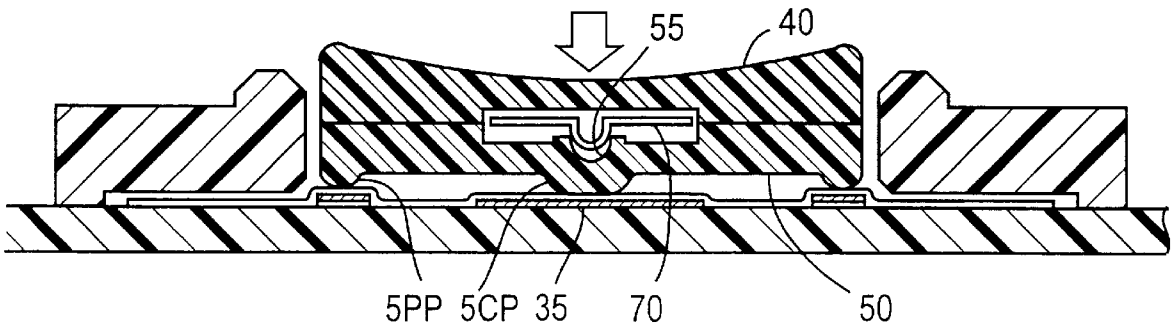
FIG. 5C is a sectional view taken along the line 4A—4A in FIG. 2 for explaining the operation of the first embodiment.

A description will be given, with reference to FIGS. 2 to 5, of a multi-direction switch according to the first embodiment of the present invention. A four-direction switch will hereinafter be described as a multi-direction switch. FIG. 2 is a perspective view of a four-direction switch provided with a center switch; FIG. 3 is an exploded perspective view of the four-direction switch shown in FIG. 2; FIGS. 4A and 4B are sectional views taken along the line 4A—4A and 4B—4B in FIG. 2, respectively; and FIGS. 5A, 5B and 5C are sectional views for explaining the operation of the four-direction switch.

As depicted in FIG. 3, a printed wiring board 31 has formed on the top surface thereof a central stationary contact 32 and four peripheral stationary contacts 33. The four peripheral stationary contacts 33 are arranged at equiangular intervals circumferentially about the central stationary contact 32. The central stationary contact 32 includes an annular but partly cut-away electrode 32*a* and a circular electrode 32*b* formed inside the annular electrode 32*a* concentrically therewith. The peripheral stationary contacts 33 each include a U-shaped electrode 33*a* and a bar-shaped electrode 33*b* formed inside the U-shaped electrode 33*a*. Reference numeral 34 designates conductor traces connected to the above-mentioned electrodes.

A dome-shaped central movable contact 35 to be positioned above the central stationary contact 32 and four peripheral movable contacts 36 to be positioned above the peripheral stationary contacts 33 are formed in one structure by punching out four holes 38 at locations near four corners of a substantially square resilient metal sheet 37 and press-working it. The central movable contact 35 is located at the center of the resilient metal sheet 37 and supported by four bridges 37B extending diagonally from the four corner portions of the metal sheet 37. The peripheral movable contacts 36 are each provided along one side of the resilient metal sheet 37. That is, each peripheral movable contact 36 is in flat strip form, and its intermediate portion 36*b* supported by both end portions 36*a* lies at a predetermined elevation with respect to the top surface of the resilient metal sheet 37. The resilient metal sheet 37 is a resilient sheet of beryllium copper or stainless steel. The central movable contact 32 and the dome-shaped central movable contact 35 constitute a central switch 320, and the peripheral stationary contacts 33 and the peripheral movable contacts 36 constitute peripheral switches 330.

A square single-sided adhesive sheet 39 is an adhesive-backed sheet by which the resilient metal sheet 37 is fixed onto the top surface of the printed wiring board 31 with the central and peripheral movable contacts 35 and 36 held at predetermined positions above the board surface.

A keytop 40 is substantially disc-shaped. A housing 10 of a square flat configuration has an opening 10H to receive the keytop 40. Extended inwardly from the inner peripheral surface of the opening 10H toward the center thereof are retaining pieces 11 for engagement with tips of legs 72 of a frame 70 described later on.

A pusher 50 molded of a synthetic resin material is attached to the underside of the keytop 40. The pusher 50 is composed of a base 51 coaxial with the central movable contact 32 and four arms 42 extending radially from the base 51 at equiangular intervals of 90°. The top surface of the base 51 of the pusher 50 forms a depression 51R relative to the arms 52. On the bottom surface of the base 51 there is provided a central press protrusion 5CP corresponding to the central movable contact 35 as shown in FIGS. 4A and 4B. On the bottom surface of each arm 52 at its extremity there is also provided a peripheral press protrusion 5PP corresponding to one of the peripheral movable contact 36 as depicted in FIG. 4A. The height of the central press protrusion 5CP relative to the underside of the pusher 50 is chosen to be larger than the height of the peripheral press protrusion 5PP.

The frame 70 has, as shown in FIG. 3, a central plate portion 71 and four legs 72 extending radially therefrom at equiangular intervals of 90° but at an angle of 45° to the arms 52 of the pusher 50 and having downturned intermediate portions formed with outturned ends. On the underside of the central plate portion 71 there is provided a fulcrum portion 71P as depicted in FIG. 4A. In this embodiment the fulcrum portion 71P is provided as a spherical protrusion. The frame 70 is stamped from a resilient metal sheet as of stainless steel and then press-worked. The frame 70 serves as the center of pivotal movement of the keytop 40 that is tilted when pressed at its marginal portion.

In the top surface of the base 51 there is formed centrally thereof an engagement portion 50R that engages with and disengages from the fulcrum portion 71P of the frame 70. In this embodiment the engagement portion 50R is provided as a spherically curved recess that receives the spherical fulcrum protrusion 71P.

Referring mainly to FIG. 3, the assembling of the multi-direction switch will be described below.

The assembling begins with mounting and positioning the resilient metal sheet 37 on the top surface of the printed wiring board 31, followed by covering the metal sheet 37 with the single-sided adhesive sheet 39 to fix it to the printed wiring board 31. On the other hand, the keytop 40 and the pusher 50 are assembled together with the frame 70 sandwiched therebetween. In this case, the frame 70 has its central plate portion 71 rested on the depression 51R of the pusher 50 and its fulcrum protrusion 71P received in the recess 50A, and the top surfaces of the arms 52 of the pusher 50 are bonded to four pedestals 41P protrusively provided on the underside of the keytop 40 in opposing relation to the arms 52, respectively. As a result, the central plate portion 71 of the frame 70 is held in a gap 4G defined by the depression 51R of the pusher 50 and the bottom surface of the keytop 40. The keytop 40 with the frame 70 and the pusher 50 thus incorporated therein is inserted into the opening 10H of the housing 10 from above and turned to bring the legs 72 of the frame 70 into engagement with the bottom surfaces of the retaining pieces 11. Then the housing 10 carrying the keytop 40 is placed on the single-sided adhesive sheet 39 and fixed, for example, by means of screws (not shown) to the printed wiring board 31 with the legs 72 of the frame 70 held between the retaining pieces 11 and the single-sided adhesive sheet 39.

In the manner described above, the four-direction switch is assembled which has the appearance depicted in FIG. 2 and the cross-sectional configuration depicted in FIGS. 4A and 4B. In this four-direction switch, as shown in FIGS. 4A and 4B, the central plate portion 71 of the frame 70 is positioned above the central movable contact 35, which is positioned, in turn, coaxially with the central press protrusion 5CP, the engagement recess 50R and the spherical fulcrum protrusion 71P. The central movable contact 35 and the central press protrusion 5CP are in resilient contact with each other, causing the engagement recess 50R to resiliently receive the fulcrum protrusion 71P when the keytop 40 is not pressed.

FIGS. 5A, 5B and 5C are explanatory of the operation of the four-direction switch described above. FIGS. 5A and 5B show the case of pressing the keytop 40 at its right and left marginal edges, respectively, and FIG. 5C shows the case of pressing the keytop 40 at the center thereof.

As depicted in FIGS. 5A and 5B, when the keytop 40 is tilted by being pressed at its marginal edge, the peripheral movable contact 36 is pressed by the peripheral press protrusion 5PP corresponding to the marginal edge being pressed, by which the peripheral movable contact 36 is elastically deformed into contact with the corresponding peripheral stationary contact 33, establishing an electrical connection between the central electrodes 33*a* and 33*b* (see FIG. 3).

In this instance, since the keytop 40 pivots on the fulcrum protrusion 71P of the frame 70 as shown, depressing the keytop 40 at its marginal portion exerts substantially no force on the central movable contact 35, that is, the central movable contact 35 does not flip; therefore, the central switch 320 remains OFF.

On the other hand, upon depressing the keytop 40 at the center thereof as depicted in FIG. 5C, the central press protrusion 5CP presses the central movable contact 35 into contact with the central stationary contact 32, providing an electrical connection between the electrodes 32*a* and 32*b*. In this case, no electrical connections are established between the peripheral electrodes 33*a* and 33*b* since the heights of the peripheral press protrusions from bottom surface of the pusher 50 are smaller than the height of the central press protrusion 5CP. In either case, upon releasing the keytop 40, the movable contacts return to their original positions.

The gap 4G between the central portion of the pusher 50 and the underside surface of the keytop 40 is provided wide enough to prevent the central plate portion 71 of the frame 70 from hindering the pivotal displacement of the keytop 40 and the pusher 50 formed in one-piece construction in the respective operation described above. The gap 4G for housing the central plate portion 71 of the frame 70 is provided, in this example, by the depression 51R formed in the top surface of the pusher 50 (see FIG. 3).

While in this example the gap 4G is provided by forming the depression 51R in the top surface of the pusher 50, it can also be formed, for instance, by increasing the heights of the pedestals 41P of the keytop 40 as required instead of providing the depression 51R in the top surface of the pusher 50.

With the central and peripheral movable contacts 35 and 36 formed as a unitary structure by the single resilient metal sheet 37 as in this example, it is possible to decrease the number of parts used and hence facilitate assembling them accordingly.

Further, since the frame 70 is fixed to the printed wiring board 31 by the retaining pieces 11 provided in the housing 10H of the housing 10 at the same time as the housing 10 is fixedly mounted on the printed wiring board 31, no particular parts are needed for fixing the frame 70 to the printed wiring board 31. The frame 70 is made of metal in this example, but it may also be molded of a resin material. From the viewpoint of mechanical strength (rigidity), however, it may preferably be made of metal.

Figure 6:
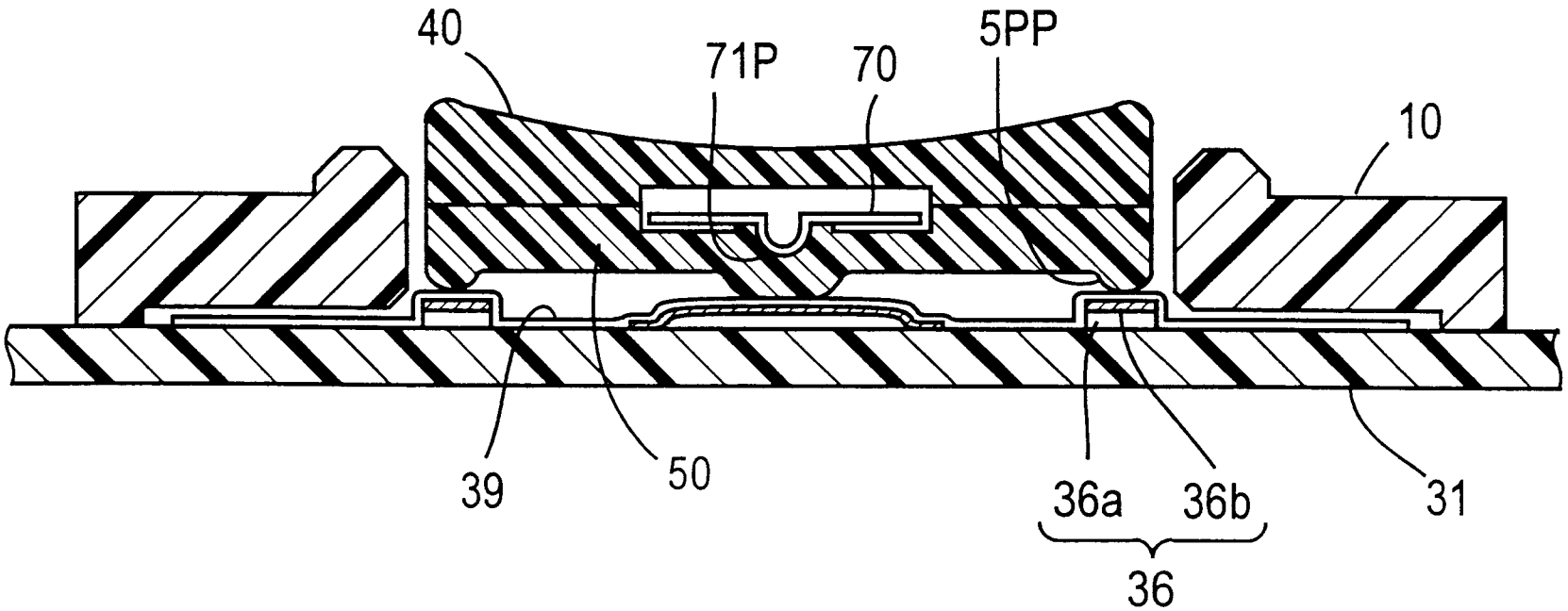
FIG. 6 is a sectional view taken along the line 4A—4A in FIG. 2, depicting a modified form of the first embodiment.
Figure 7:
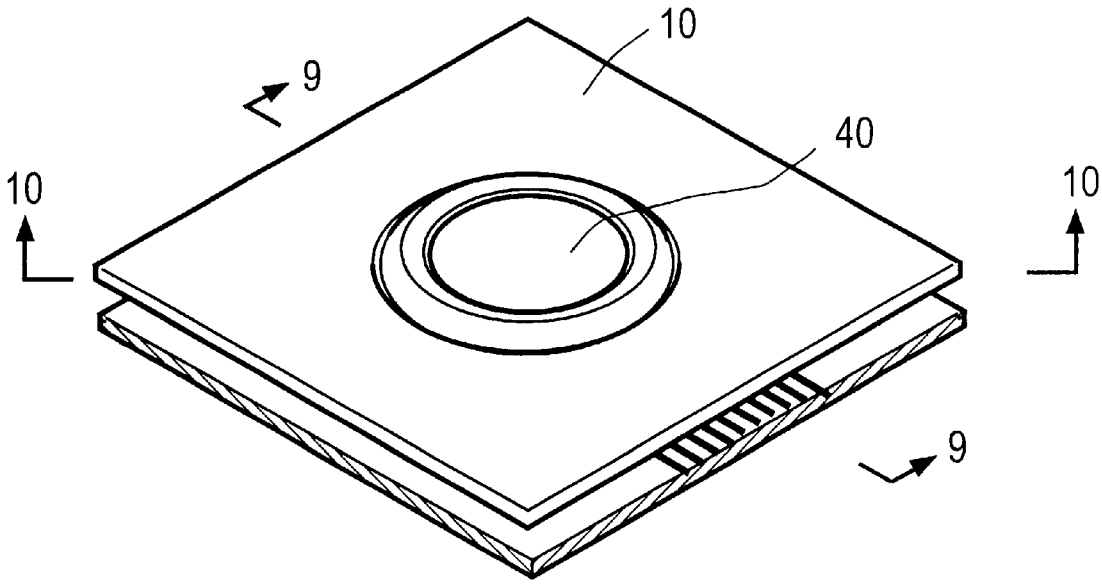
FIG. 7 is a perspective view of a multi-direction switch according to a second embodiment of the present invention.

FIG. 6 illustrates a modified form of the above example, in which the intermediate portion 36*b* of each peripheral movable contact 36 is elevated to a higher level such that it abuts the corresponding peripheral press protrusion 5PP when the keytop 40 is not pressed. This structure suppresses wobbling of the actuation key 40 when it is depressed at the center thereof, and hence stabilizes it.

The present invention features a structure in which the pusher 50 is fixed to the keytop 40 and the legs 72 extend out from the central plate portion 71 of the frame 70 sandwiched between the keytop 40 and the pusher 50 and are fixed to the printed wiring board 31 to thereby couple thereto the keytop 40. Besides, the gap 4G is provided between the keytop 40 and the pusher 50 so that the bottom surface of the keytop 40 (or the upper surface of the pusher 50) is pivotable with respect to the central plate portion 71 of the frame 70 fixed to the printed wiring board 31.

In the multi-direction switch according to the first embodiment described above, as depicted in FIGS. 4A and 4B, the pusher 50 is resiliently biased by the resiliency of the central movable contact 35 toward the bottom surface of the frame 70, causing the spherical fulcrum protrusion 71P on the underside of the central plate portion 71 of the frame 70 to be resiliently received in the engagement recess 50R. In order to provide a gap g in which the pusher 50 can pivot a desired angle between the underside of the central plate portion 71 of the frame 70 and the upper surface of the pusher 50 opposite thereto, the height h of the spherical fulcrum protrusion 71P from the bottom surface of the central plate portion 71 of the frame 70 and the depth d (not shown) of the engagement recess 50R from the upper surface of the depression 51R of the pusher 50 are determined such that $d+g=h$, where $g>0$. In this instance, a gap is also provided between the upper surface of the central plate portion 71 and the bottom surface of the keytop 40 opposite thereto, and the size of this gap is chosen to accommodate the pivotal movement of the pusher 50 through the maximum angle and to be larger than the minimum downward stroke of the keytop 40 for turning ON the central switch 320 by pressing the keytop 40 at the center thereof.

The basic configurations and requirements mentioned above are common as well to all the other embodiments described later on.

In the first embodiment, the movable contacts have been described to be formed in one-piece construction, but it is also possible to form the peripheral movable contacts separately of the dome-shaped central movable contact and use dome-shaped movable contacts as the peripheral movable contacts or provide metal domes in the peripheral movable contacts so that they have good tactile feedback.

Second Embodiment

The first embodiment of the construction described above achieves independent activation of the central switch 320 and the four peripheral switches 330 through depression of the keytop 40. However, the first embodiment is defective in that the overall switch structure is thick because of a substantial thickness of the pusher 50 and in that assembly is inefficient because of a timing-consuming step of putting the legs 72 of the frame 70 between the bottom surfaces of the retaining pieces 11 and the printed wiring board 31 with the adhesive sheet 39 sandwiched therebetween. Furthermore, since the central and peripheral movable contacts 35 and 36 are molded in one-piece of resilient sheet metal, a plurality of switches are shorted when they are simultaneously turned ON by excessive downward pressures on the keytop—this imposes limitations on the design of an electronic circuit that uses the multi-direction switch. Next, a description will be given of an embodiment adapted to overcome these problems.

Figure 8:
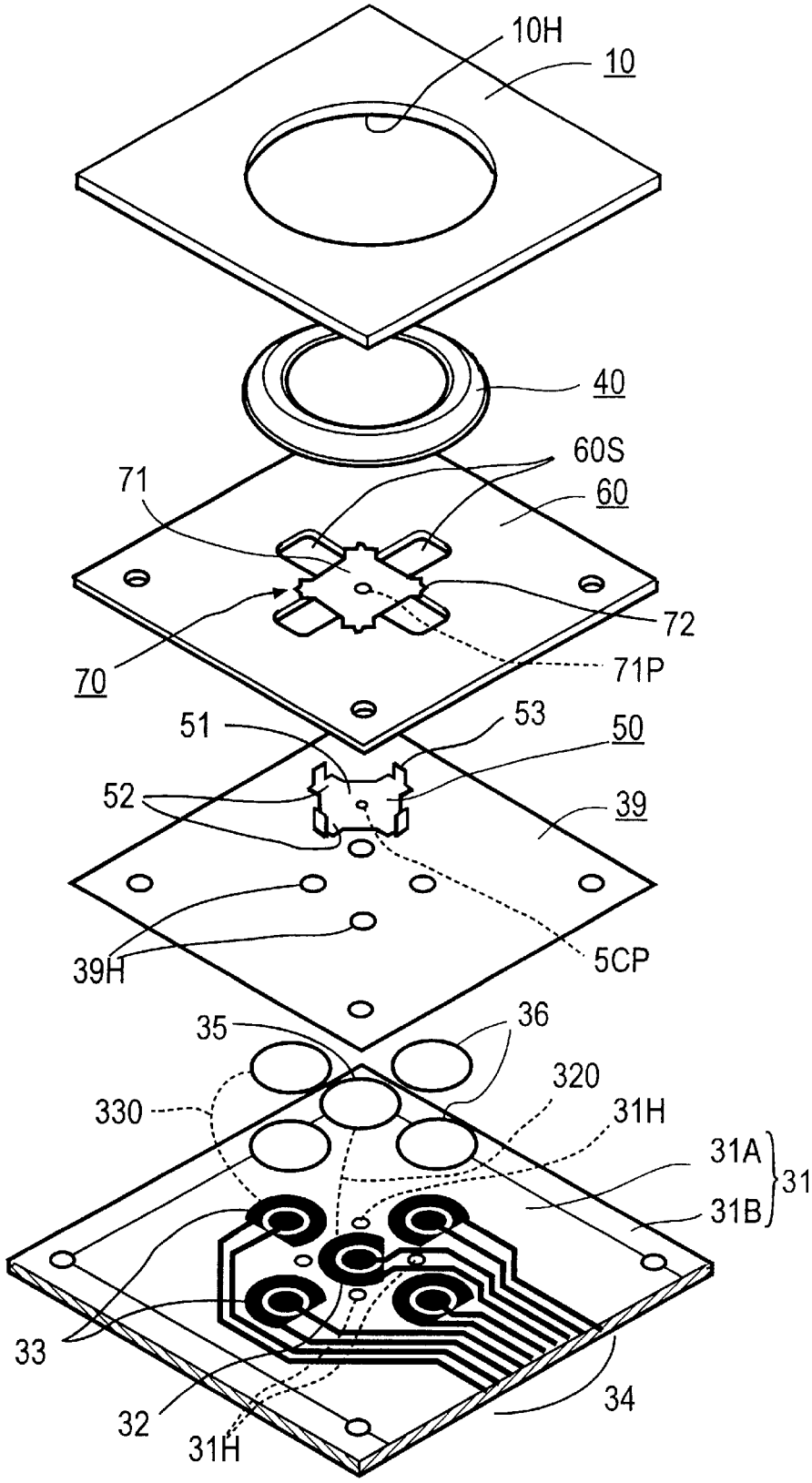
FIG. 8 is an exploded perspective view of the FIG. 7 embodiment.

FIGS. 7 through 10 illustrate a second embodiment of the present invention. In the multi-direction switch of the second embodiment, depicted in perspective in FIG. 7, the printed wiring board 31 is made up of a substrate 31B and a printed wiring sheet 31A pasted on the substrate surface as shown in FIG. 8 that is an exploded perspective view of the multi-direction switch according to this embodiment. On the top surface of the printed wiring sheet 31A there are formed the central stationary contact 32 and the four peripheral stationary contacts 33. The four peripheral stationary contacts 33 are regularly spaced about the central stationary contact 32. The central and peripheral stationary contacts 32 and 33 are each composed of a central circular electrode and an annular electrode formed concentrically therewith. Reference numeral 34 denotes electrical traces as leads connected to the stationary contacts 32 and 33.

The dome-shaped central movable contact 35 and four dome-shaped peripheral movable contacts 36 are provided individually, and they are all flipping contacts that flip with a click feel. The central stationary contact 32 and the dome-shaped central movable contact 35 constitute the central switch 320, whereas the peripheral stationary contacts 33 and the dome-shaped peripheral movable contacts 36 constitute the peripheral switches 330.

The square single-sided adhesive sheet 39 backed with an adhesive is used to fixedly position the central movable contact 35 and the four peripheral movable contacts 36 above the electrode pairs of the central stationary contact 32 and the four peripheral stationary contacts 33, respectively, formed on the top surface of the printed wiring sheet 31A. Reference numeral 31H denotes through holes bored through the printed wiring board 31.

The pusher 50, which is used to push the dome-shaped central movable contact 35, is stamped from a metal sheet and then press-worked. The pusher 50 has the central flat base 51 and the arms 52 extending crosswise therefrom radially, the ends of the arms 52 being upturned at right angles to the base 51 to form mounting lugs 53. In this embodiment, too, the pusher 50 has the downward spherical press protrusion 5CP formed by press-working the base 51 centrally thereof.

Figure 10:
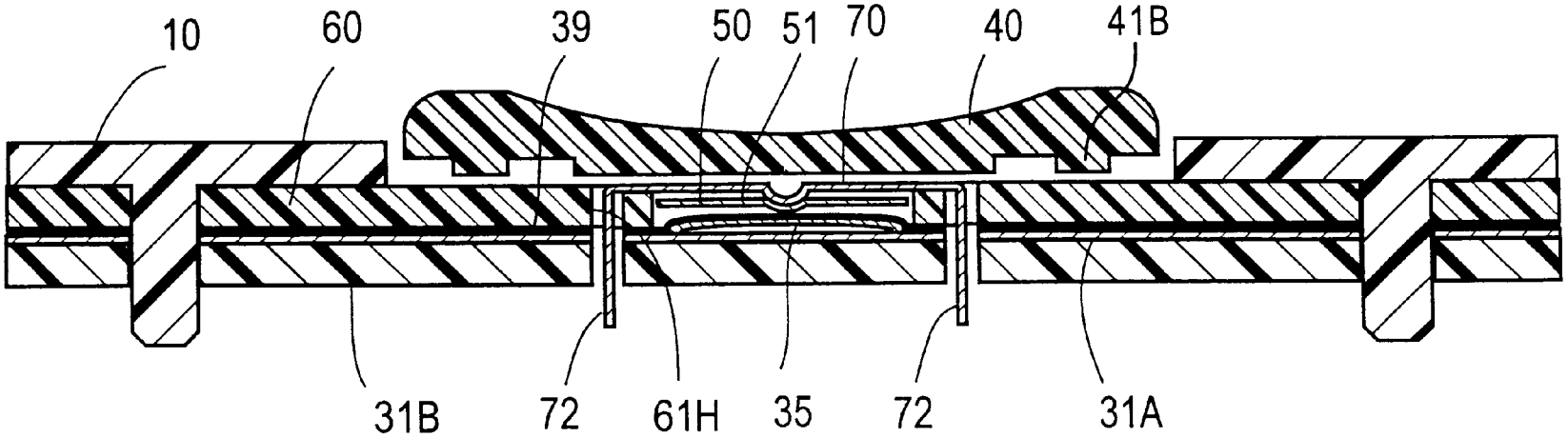
FIG. 10 is a sectional view taken along the line 10—10 in FIG. 7.
Figure 11:
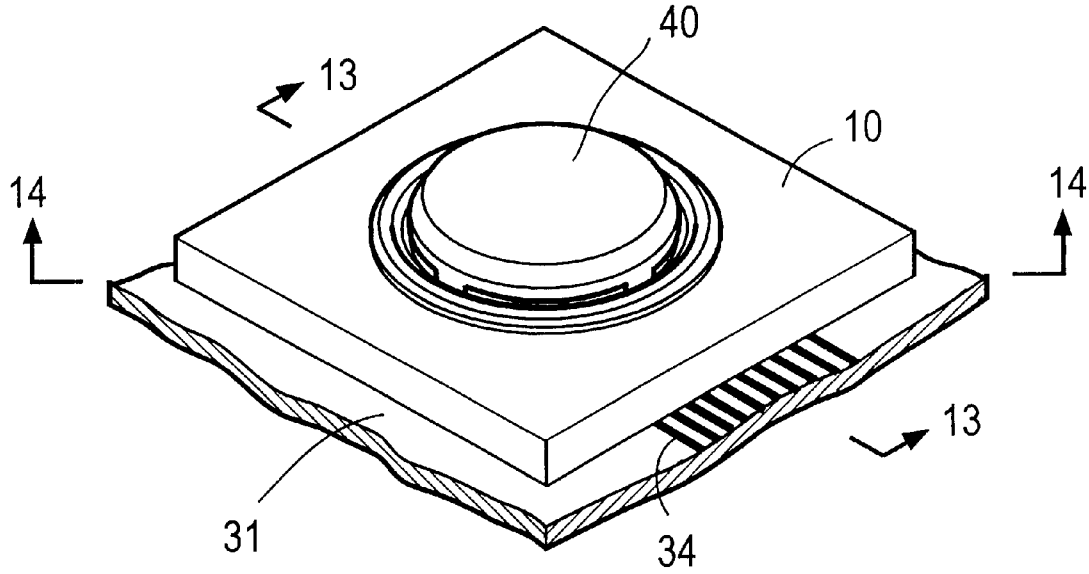
FIG. 11 is a perspective view of a multi-direction switch according to a third embodiment of the present invention.

The frame 70 is stamped from a sheet metal and press-worked and has the central plate portion 71 and four guide legs 72 downturned at its four corners (see FIG. 10). The frame 70 also has the downward spherical fulcrum portion 71P formed by press-working its central plate portion 71 at the center thereof.

The four guide legs 72 of the frame 72 are inserted and fixed in through holes 61H bored through a mounting plate 60 (see FIG. 10), the guide legs 72 further extending through holes 39H of the single-sided adhesive sheet 39 and down into the holes 31H made in the printed wiring board 31. In the center of the mounting plate 60 there is formed a thick cross-shaped slit 60S at an angle of 45° to the diagonal directions of the four through holes 61H. The base 51 of the pusher 50 underlies the cross-shaped slit 60S at the center thereof, with the arms 52 extending into four slit portions of the cross-shaped slit 60S. As depicted in FIGS. 9 and 10, the base 51 of the pusher 50 is thin enough to be accommodated within the thickness of the cross-shaped slit 60S of the mounting plate 60, which functions as a spacer between the pusher 50 and the frame 70.

Figure 9A:
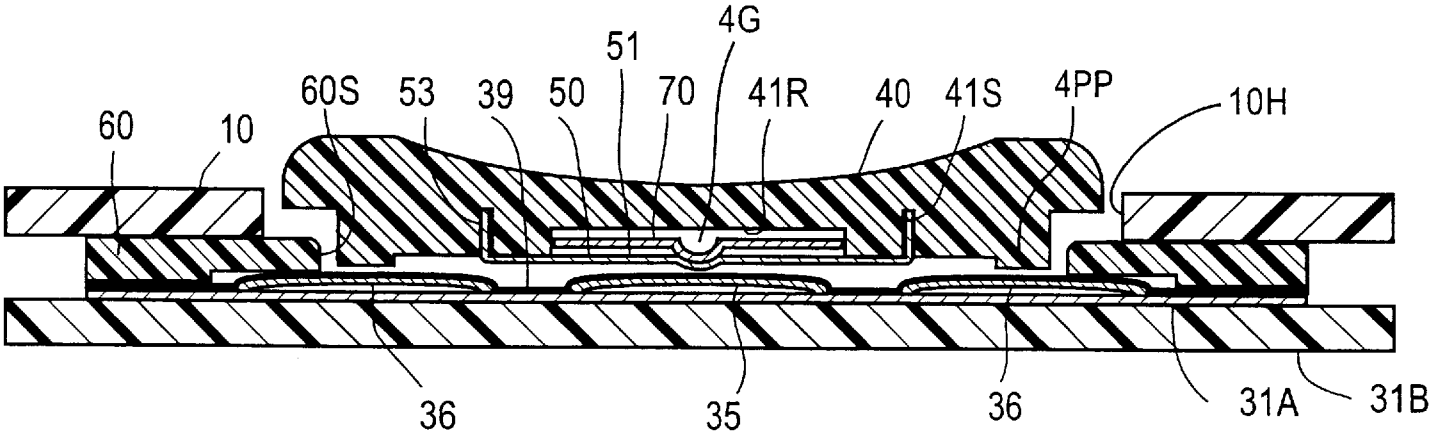
FIG. 9A is a sectional view taken along the line 9—9 in FIG. 7 for explaining the operation of the second embodiment.
Figure 9B:
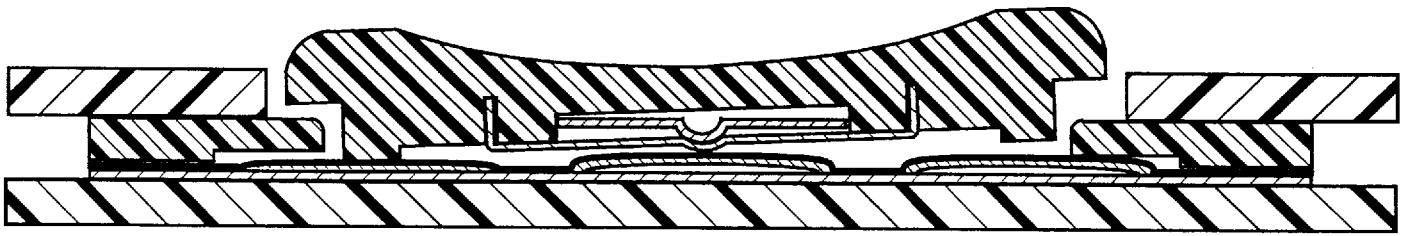
FIG. 9B is a sectional view taken along the line 9—9 in FIG. 7 for explaining the operation of the second embodiment.
Figure 9C:
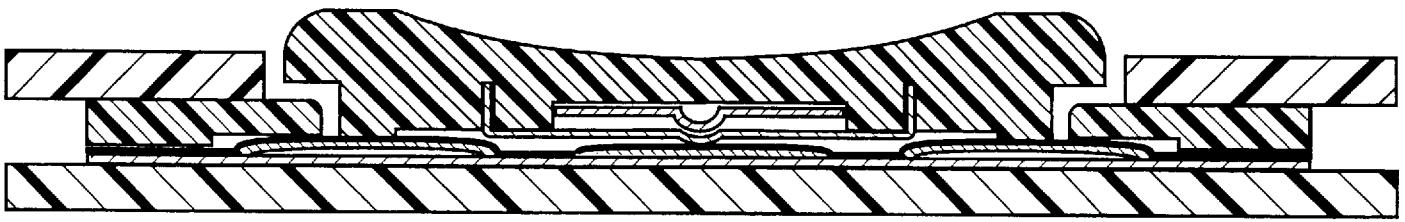
FIG. 9C is a sectional view taken along the line 9—9 in FIG. 7 for explaining the operation of the second embodiment.

As in the case of the first embodiment, in order to provide the gap 4G between the bottom surface of the keytop 40 and the top surface of the pusher 50, there is formed in the underside of the keytop 40 centrally thereof a substantially rectangular recess 41R in which the central plate portion 71 of the frame 70 is loosely fitted (see FIG. 9A), and outside the respective sides of the rectangular recess 41R there are formed in the keytop 40 slits 41S in which the mounting lugs 53 of the pusher 50 are fitted (see FIG. 9A). Further, in this embodiment there are protrusively provided bosses 41B (see FIG. 10) on the underside of the keytop 40 at positions corresponding to those circumferentially intermediate between adjacent peripheral switches 330 regularly spaced about the central switch 320. These bosses 41B are intended to prevent adjacent switches form turning ON at the same time. And, in this embodiment the central movable contact 35 is pressed onto the central stationary contact 32 by the central press protrusion 5CP of the pusher 50, whereas the peripheral movable contacts 36 are pressed onto the corresponding peripheral stationary contacts 33 directly by peripheral press protrusions 4PP (see FIG. 9A) provided on the underside of the keytop 40 at positions corresponding to the peripheral movable contacts 36, respectively.

The housing 10 has the centrally-disposed opening 10H in which the keytop 40 is positioned.

Next, a description will be given of assembly of the four-direction switch according to this embodiment. In the first place, the dome-shaped central movable contact 35 and the four dome-shaped peripheral movable contacts 36 are positioned with respect to the central stationary contact 32 and the four peripheral stationary contacts 33 formed on the printed wiring sheet 31A bonded to the top surface of the substrate 31B, after which the single-sided adhesive sheet 39 is pasted to the printed wiring sheet 31A from above.

As depicted in FIG. 10, the guide legs 72 of the frame 70 is inserted into the through holes 61H until the bottom surface of the central plate portion 71 of the frame 70 reaches the top surface of the mounting plate 60, and then the legs 72 are secured by adhesive to the mounting plate 60. Alternatively, the through holes 61 are made small in diameter and the legs 72 are pressed into them.

The mounting lugs 53 of the pusher 50 are press-fitted into the slits 41S in the bottom surface of the keytop 40 with the central plate portion 71 of the frame 70 mounted on the mounting plate 60 interposed between the underside of the keytop 40 and the pusher 50, whereby the keytop 40, the frame 70 and the pusher 50 are assembled into a unitary structure. As a result, the central plate portion 71 of the frame 70 is received in the central recess 41R formed in the underside of the keytop 40 in a manner to be pivotable relative to the keytop 40. Then, the guide legs 72 of the frame 70 extending out downwardly of the mounting plate 60 are passed through the through holes 39H of the single-sided adhesive sheet 39 and inserted into the through holes 31H of the wiring board 31 to thereby position the mounting plate 60 on the single-sided adhesive sheet 39, after which the substrate 31B, the mounting plate 60 and the housing 10 thus stacked one upon another are mechanically coupled into a one-piece structure by screwing or some other means.

Since the gap 4G is provided between the underside of the keytop 40 and the pusher 50 to meet the requirement referred to previously with reference to the first embodiment, the central plate portion 71 of the frame 70 fixed to the printed wiring board 31 does not constitute an obstacle to the pivotal displacement of the keytop 40 when it is pressed as required. The underside of the keytop 40 and the pusher 50 are joined to each other by press-fitting the mounting lugs 53 of the pusher 50 into the slits 41S cut in the underside of the keytop 40, but they may be adhesively bonded directly to each other instead.

The cross-shaped slit 60S cut in the mounting plate 60 centrally thereof arouses a fear that dust and waterdrops entering from between the keytop 40 and the opening 10H of the housing further intrude into the switch structure through the slit 60S. The intrusion by dust and waterdrops can be prevented by bonding a dustproof, dripproof sheet to the bottom surface of the mounting plate 60. It is also possible to protect the switch against intrusion of dust and waterdrops by fixedly securing a seal ring to the bottom surface of the mounting plate 60 over an area covering the slit 60S.

The four-direction switch thus assembled enables each of the central and peripheral switches 320 and 330 to be activated independently by pressing the keytop 40 as is the case with the first embodiment.

This embodiment uses the pusher made from sheet metal instead of using the pusher molded of a synthetic resin material in the first embodiment, and hence it provides a lower-profile switch structure. Further, since the respective movable contacts are each provided independently of the others, simultaneous conduction of plural switched will not cause shorting between them. Besides, the bosses 41B protrusively provided on the underside of the keytop 40 as described previously prevent adjacent peripheral switches from being simultaneously pressed.

Third Embodiment

Turning next to FIGS. 11 to 14, a third embodiment of the present invention will be described below.

The printed wiring board 31 has the through holes 31H bored therethrough. On the top surface of the printed wiring sheet 31A there are formed the central stationary contact 32 and the four peripheral stationary contact 33. The stationary contacts 32 and the movable contacts 35 and 36 corresponding thereto are identical in configuration and arrangement with those in the second embodiment, and the movable contacts 35 and 36 are positioned and held on the printed wiring sheet 31A by the single-sided adhesive sheet 39 in the same manner as in the second embodiment; therefore, no description will be given of them.

As is the case with the pusher 50 in the second embodiment shown in FIG. 8, the cross-shaped pusher 50 made from sheet metal, which presses the dome-shaped central movable contact 35, has four arms 52 extending crosswise from the base 51 and having their ends upturned to form the mounting lugs 53 and also has the downward spherical press protrusion 5CP in the base 51 formed by press-working it in the center.

The frame 70 made from sheet metal has four legs 72 extended from four corners of the substantially rectangular central plate portion 71 at right angles thereto toward the printed wiring board 31 and having guide pieces 72G at their ends. The legs 72 each have a stepped portion intermediate the length thereof so as to hold the central plate portion 71 at a desired elevation above the printed wiring board 31. The central plate portion 71 has the downward spherical fulcrum portion 71P centrally thereof by press-working.

A rectangular elastic sheet 80 made from a flexible or pliant sheet of rubber has a relatively thick marginal frame 81 formed along its marginal edge to support the pliant central portion. The elastic rubber sheet 80 has in its central portion an opening 80H of a diameter smaller than that of the keytop 40 but larger than the diameter of the central recess 41R provided in the underside of the keytop 40. The opening 80H is surrounded by a relatively thick annular ridge 82 formed along its marginal edge.

Figure 12:
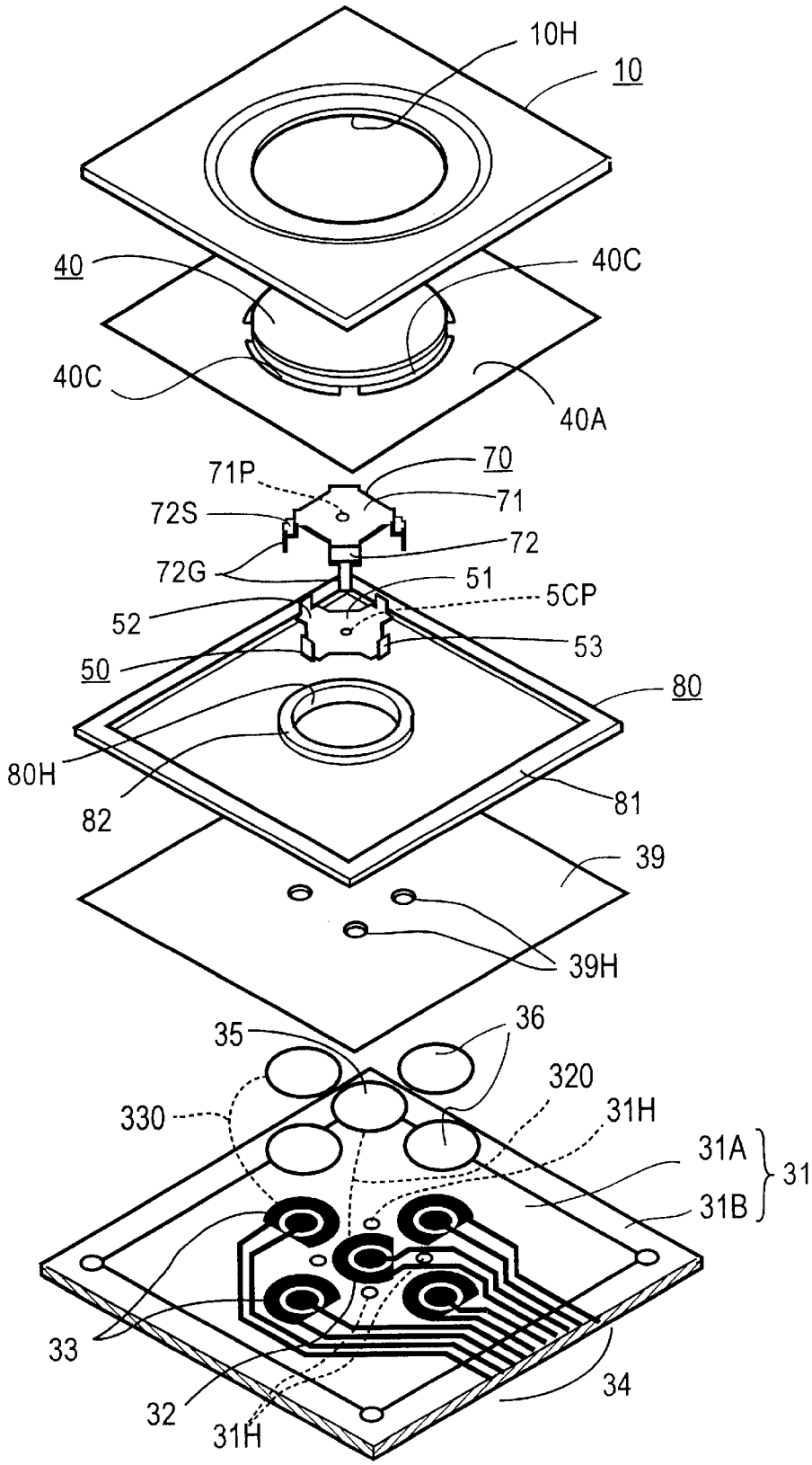
FIG. 12 is an exploded perspective view of the FIG. 11 embodiment.
Figures 13A, 13B, 13C, 13D:
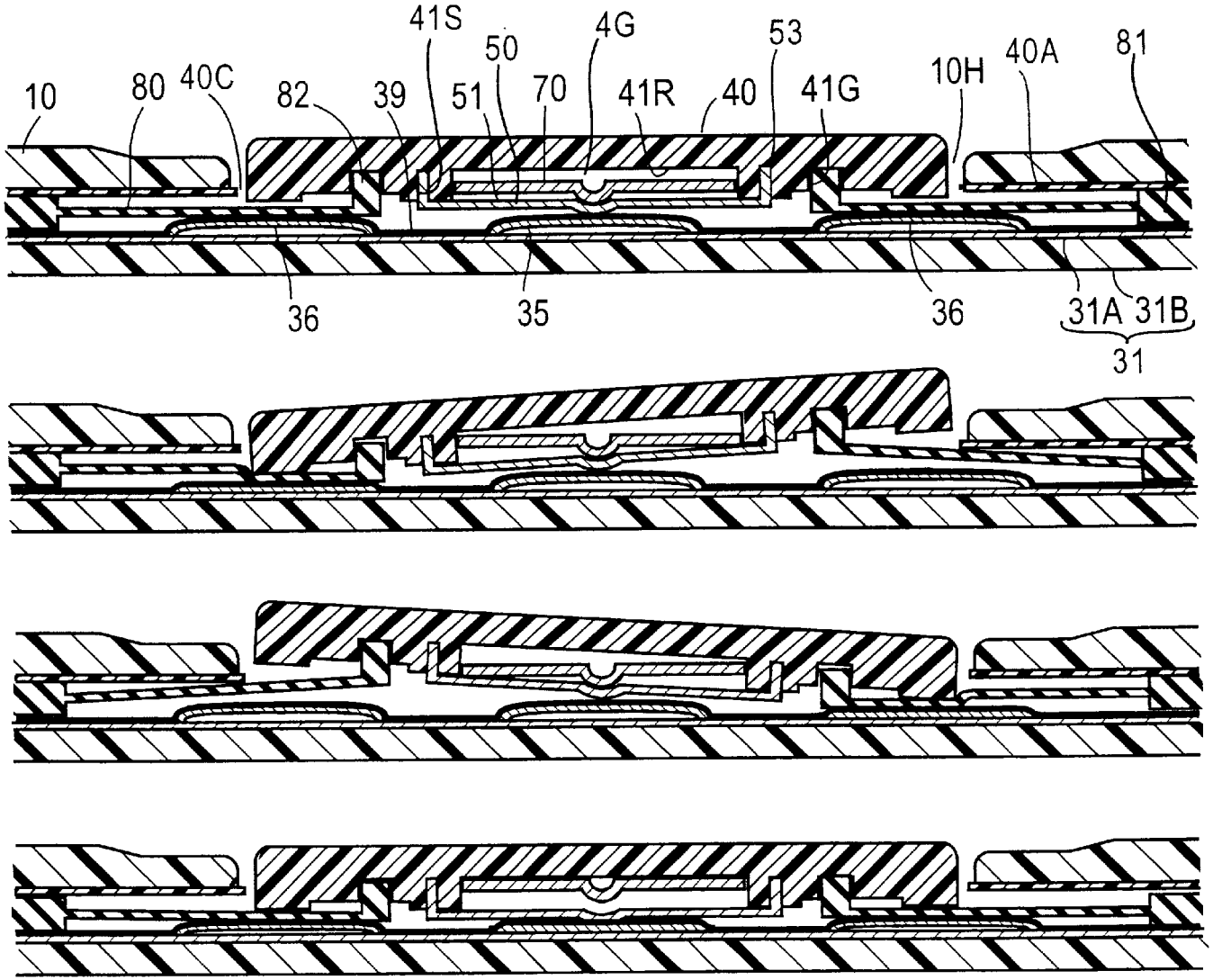
FIG. 13A is a sectional view taken along the line 13—13 in FIG. 11 for explaining the operation of the third embodiment.
FIG. 13B is a sectional view taken along the line 13—13 in FIG. 11 for explaining the operation of the third embodiment.
FIG. 13C is a sectional view taken along the line 13—13 in FIG. 11 for explaining the operation of the third embodiment.
FIG. 13D is a sectional view taken along the line 13—13 in FIG. 11 for explaining the operation of the third embodiment.
Figure 14:
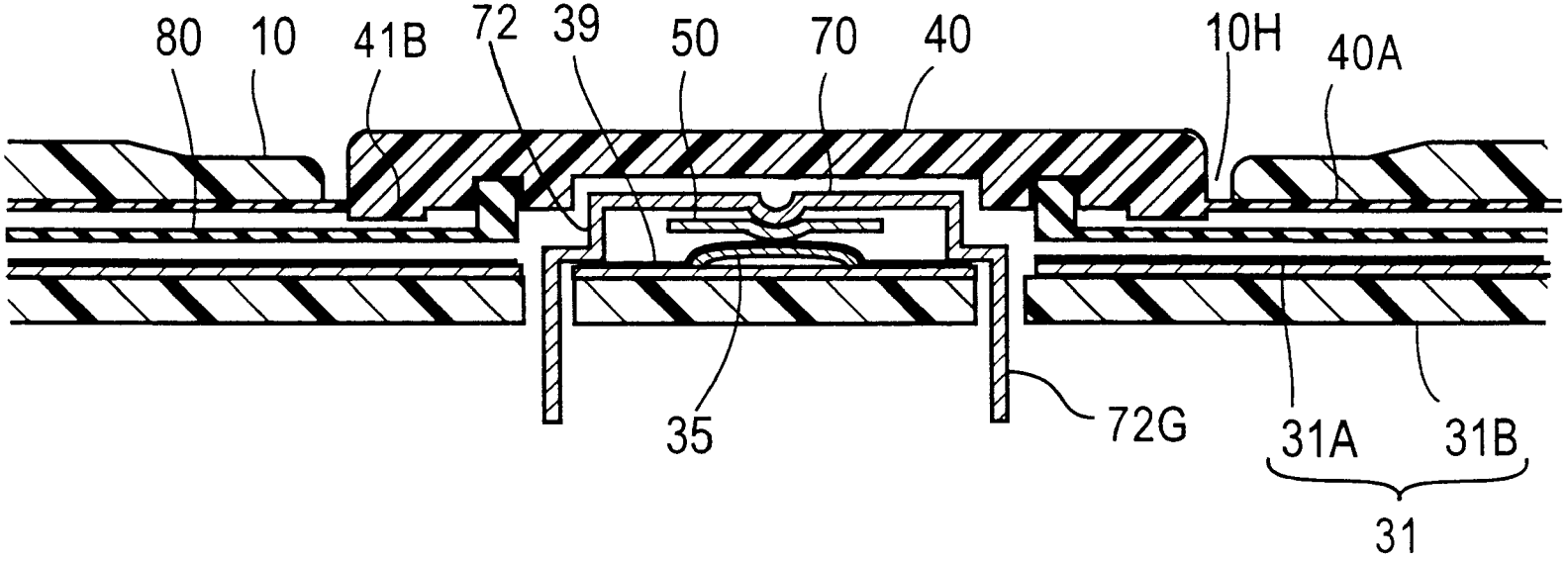
FIG. 14 is a sectional view taken along the line 14—14 in FIG. 11.

The keytop 40 is formed integrally with a keytop sheet 40A spreading around it. In the keytop sheet 40A there are made, as depicted in FIG. 12, four circularly arcuate cut-outs 40C around the keytop 40 so as to permit its tilting toward any of the peripheral switches. The elastic sheet 80 is sandwiched between the keytop sheet 40A and the single-sided adhesive sheet 39 with the annular ridge 82 of the elastic sheet 80 resiliently fitted in an annular groove 41G (FIG. 13A) cut in the underside of the keytop 40 outside the central recess 41R in which the frame 70 is loosely fitted.

The pusher 50 and the frame 70 are disposed inside the opening 80H of the elastic sheet 80. And, as in the case of the second embodiment, there are protrusively provided bosses 41B (see FIG. 14) on the underside of the keytop 40 at positions corresponding to those circumferentially intermediate between adjacent peripheral switches 330 regularly spaced about the central switch 320. The housing 10 has the centrally disposed opening 10H in which the keytop 40 is positioned. The keytop 40 is operable in the state in which the elastic sheet 80 underlying the housing 10 and the keytop 40 are coupled together by the resilient engagement between the annular ridge 82 and the annular groove 41G, and consequently, it is possible to protect the switch pressing mechanism from intrusion by dust, liquid and other foreign substances.

The assembling of the four-direction switch according to the third embodiment will be described below. In the first place, the four mounting lugs 53 of the pusher 50 holding therebetween the central plate portion 71 of the frame 70 on the base 51 are press-fitted into the slits 41S cut in the underside of the keytop 40. Next, the keytop 40 is coupled to the elastic sheet 80 by press-fitting the annular ridge 82 of the elastic sheet 30 into the annular groove 41G cut in the underside of the keytop 40 with the frame 70 and the pusher 50 received in the opening 80H of he elastic sheet 80. Next, the elastic sheet 80 is positioned on the single-sided adhesive sheet 39, then the guide pieces 72S of the legs 72 of the frame 70 are inserted through the through holes 39H of the single-sided adhesive sheet 39 and the through holes 31H of the printed wiring board 31 until the stepped portions 72S of the legs 72 abut against the single-sided adhesive sheet 39, and the extending ends of the guide pieces 72S are swaged to thereby fixedly mount the frame 70, the cross-shaped pusher 50 and the keytop 40 on the wiring board 31.

As a result, the cross-shaped pusher 50 and the frame 70 can be positioned above the central switch 320 formed on the printed wiring sheet 31A. Finally, the housing 10 is placed on the keytop sheet 40A with the keytop 40 received in the opening 10H, and the substrate 31B, the elastic sheet 80 and the keytop sheet 40A thus stacked one upon another are fixedly coupled by screwing or some other means. In this embodiment, however, the keytop 40 is held by the elastic sheet 80, it is also possible to merely press the arms 52 of the pusher 50 against the underside of the keytop 40 by the resiliency of the central movable contact 35 without providing the mounting lugs 53.

The third embodiment described above also implements a low-profile four-direction switch structure since the central plate portion 71 of the frame 70 made from sheet metal is received in the central recess 41R formed in the underside of the keytop 40 and since the cross-shaped pusher 50 also made from sheet metal for pressing the dome-shaped central movable contact 35 is incorporated in the keytop 40. Besides, the bosses 41B protrusively provided on the underside of the keytop 40 as described previously prevent adjacent peripheral switches from being simultaneously pressed.

Fourth Embodiment

The above-described embodiment is disadvantageous in that assembly is complicated since the legs 72G of the legs 72 of the frame 70 are passed through the through holes of the wiring board 31 and swaged thereon to fix thereto the frame 70. Referring next to FIGS. 15 to 18, an embodiment will be described below which is intended to overcome the problem.

Figure 16:
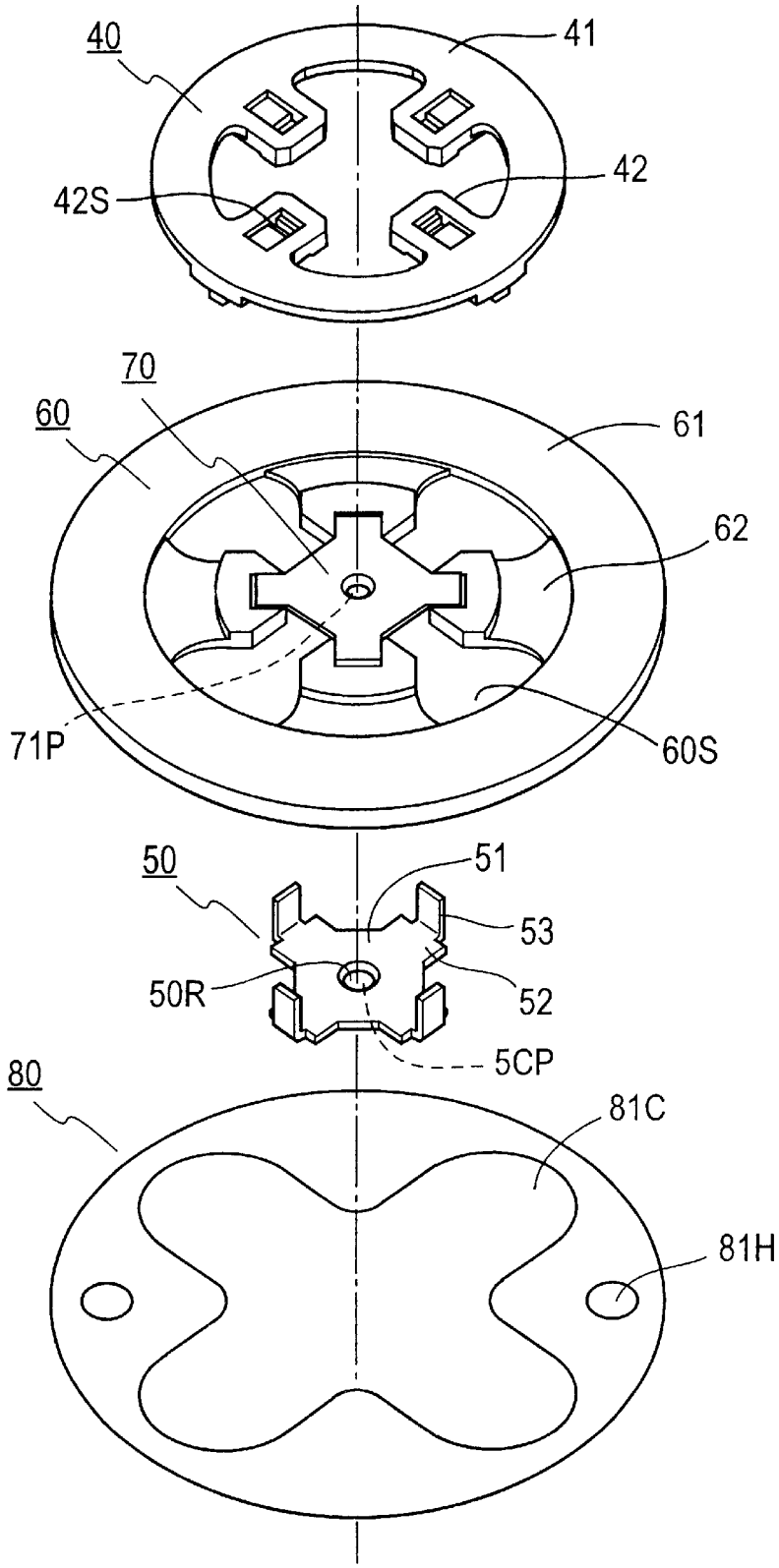
FIG. 16 is an exploded perspective view of part of the FIG. 15 embodiment.
Figure 17A:
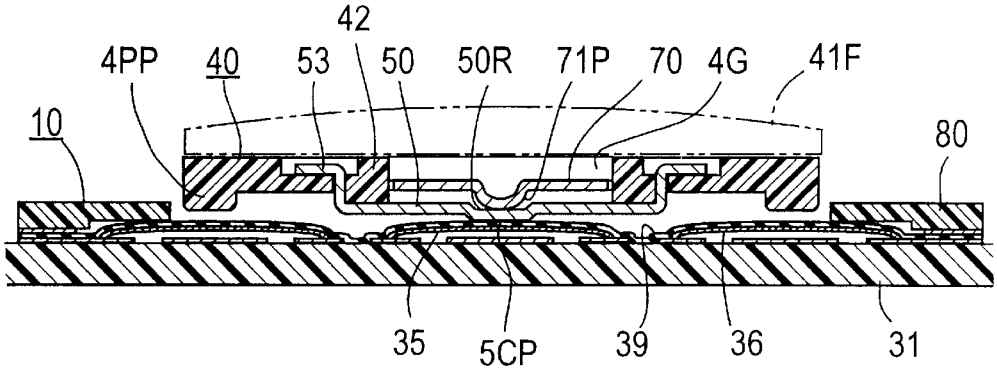
FIG. 17A is a sectional view taken along the line 17—17 in FIG. 15 for explaining the operation of the fourth embodiment.

In this embodiment, a top face 41A, which forms the top of the keytop 40 as indicated by the broken lines in FIG. 17A, is provided separately of the keytop body so that the design (shape and color) of the keytop 40 can easily be changed to meet customer needs, and the top face 41A of a desired design is mounted on the keytop body. Accordingly, in FIG. 15 that shows in perspective this embodiment the four-direction switch is depicted without the top face 41A. The parts of this embodiment shown in FIG. 16 can be replaced with the keytop 40, the mounting plate 60, the frame 70 and the pusher 50 in the second embodiment of FIG. 8; only the keytop 40, the frame 70, the pusher 50 and a double-sided adhesive sheet 80 are shown in FIG. 16. The housing 10, the printed wiring board 31, the central and peripheral movable contacts 35 and 36, and the single-sided adhesive sheet 39 are provided as depicted in FIGS. 17A through 17D, but in FIG. 16 they are not shown.

In this embodiment, as depicted in FIG. 16, the keytop 40 as of synthetic resin has an annular portion 41 and four support protrusions 42 protruding at 90° intervals from the inner periphery of the annular portion 41 toward the center thereof. In this embodiment, the gap 4G in which the central plate portion 71 of the frame 70 is received and fixed is defined inside the annular portion 41 of the keytop 40 by the bottom surface of the top face 41F that is mounted afterward and the top surface of the pusher 50. And this embodiment does not have the bosses 41B (see FIGS. 10 and 14) provided on the underside of the keytop 40 in the second and third embodiments so as to prevent simultaneous actuation of two adjacent peripheral movable contacts, but this embodiment rather allows simultaneous actuation of two adjacent peripheral movable contacts. However, this fourth embodiment may also be provided with the bosses 41B, and conversely, the second and third embodiments may be adapted to allow simultaneous actuation of adjacent peripheral movable contacts.

Each support protrusion 42 has a slit 42S bored therethrough. The mounting lugs 53, upstanding from the four arms 52 of the pusher 50 at right angles thereto as in the case of the second embodiment of FIG. 8 and holding each side of the central plate portion 71 of the frame 70 between two adjacent lugs 53, are passed through the slits 42S of the keytop 40, and the projecting ends of the lugs 53 are bent and fixed to support protrusions 42 as shown in FIGS. 17A to 17D. In this embodiment the press protrusion 5CP of the pusher 50 has a flat face as depicted in FIGS. 17A to 17D with a view to preventing the central movable contact 35 from being excessively pressed at a particular position to such an extent that it is permanently deformed. The flat face configuration of the press protrusion 5CP of the pusher 50 is applicable to all the other embodiments as well.

Figure 18A:
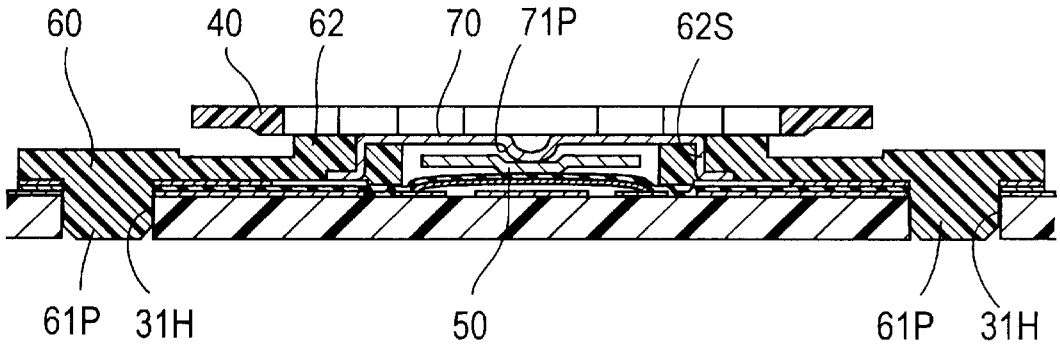
FIG. 18A is a sectional view taken along the line 18—18 in FIG. 15 for explaining the operation of the fourth embodiment.
Figure 18B:
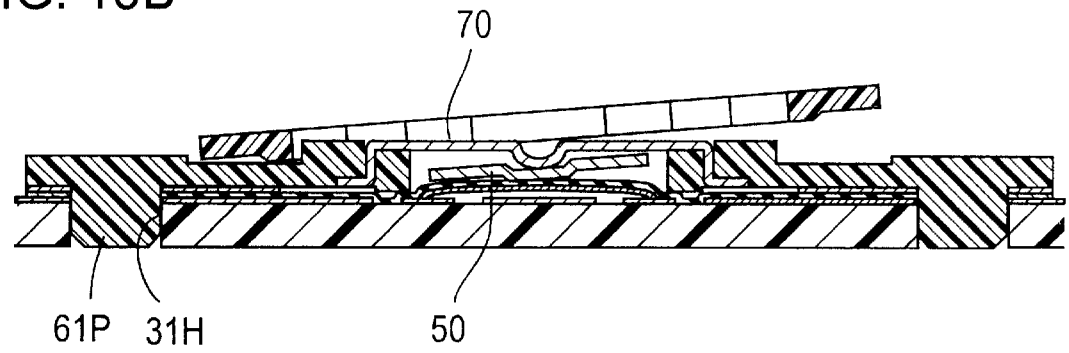
FIG. 18B is a sectional view taken along the line 18—18 in FIG. 15 for explaining the operation of the fourth embodiment.

The annular mounting plate 60 molded of a synthetic resin material has an annular portion 61 and four support protrusions 62 protruding at 90° intervals from the inner periphery of the annular portion 61 toward the center thereof. As depicted in FIGS. 18A and 18B, the legs of the frame 70 are passed through slits 62S cut in the support protrusions 62 of the mounting plate 60 and their projecting ends are bent outwardly, by which the frame 70 is fixedly mounted on the mounting plate 60. In the state in which the pusher 50 holding the central plate portion 71 of the frame 70 is secured to the keytop 40, the support protrusions 42 of the keytop 40 and the support protrusions 62 of the mounting plate 60 are displaced 45° apart from each other, and the direction of the diameter of the keytop 40 between a pair of diametrically opposed support protrusion 42 is in alignment with the line joining the corresponding pair of peripheral movable contacts 36.

On the underside of the mounting plate 60 there are protrusively provided mounting pins 61P as depicted in FIGS. 18A and 18B, and these pins 61P are passed through pin holes 81H of the double-sided adhesive sheet 80 and inserted and fixed in the pin holes 31H of the printed wiring board 31. Accordingly, the legs of the frame 70 are not directly fixed in the holes 31H of the printed wiring board 31 but are fixed thereto indirectly through the mounting plate 60.

The circular double-sided adhesive sheet 80 is used to paste the mounting plate 60 onto the single-sided adhesive sheet 39 in FIG. 8, and has a large cross-shaped cut-out 81C formed centrally thereof so that the base 51 and four arms 52 of the pusher 50 and four press protrusions 4PP (FIG. 17A) provided on the underside of the keytop 40 are not bonded to the sheet 80.

In this embodiment, the frame 70 is fixed to the mounting plate 60, then the frame 70 with its central plate portion 71 held by the mounting lugs 53 of the arms 52 of the pusher 50 is incorporated in the keytop 40 from below by the pusher 50 and fixed to the keytop 40 by passing the lugs 53 through the slits 42S of the keytop 40 and bending their ends outwardly.

The double-sided adhesive sheet 80 is pasted onto the single-sided adhesive sheet 39 shown in FIG. 8 at a predetermined position so that the four peripheral switches 330 each lie in the corresponding one of four arm-like areas of the cross-shaped cut-out 81C of the sheet 80. And the mounting plate 80 needs only to be pasted onto the sheet 80.

Figure 15:
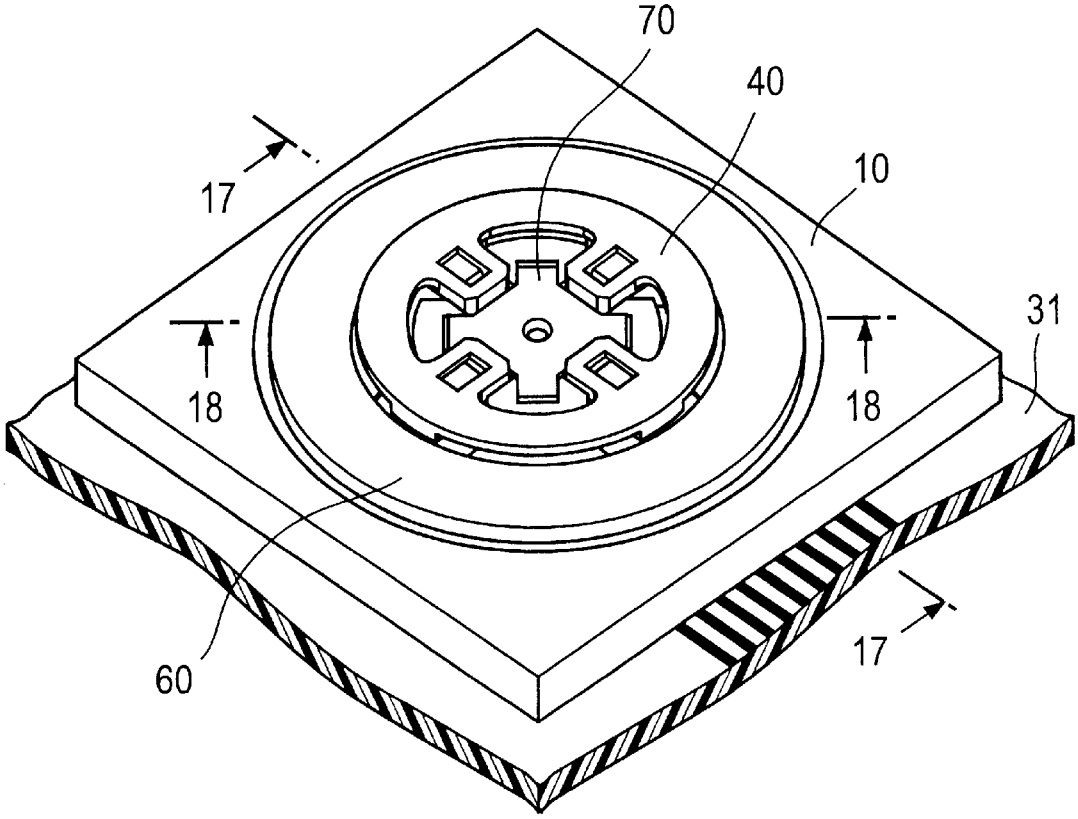
FIG. 15 is a perspective view of a multi-direction switch according to a fourth embodiment of the present invention.
Figure 17B:
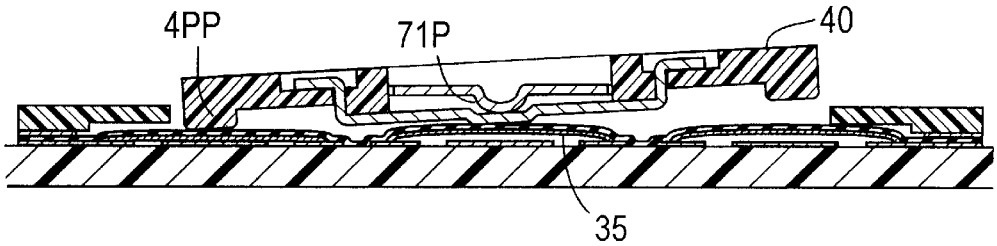
FIG. 17B is a sectional view taken along the line 17—17 in FIG. 15 for explaining the operation of the fourth embodiment.
Figure 17C:
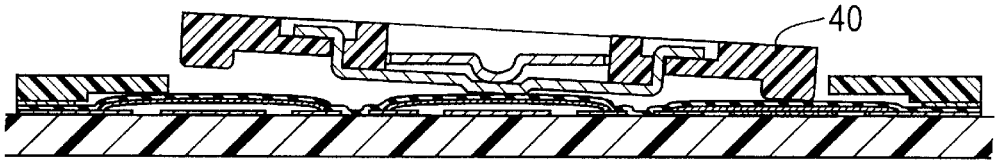
FIG. 17C is a sectional view taken along the line 17—17 in FIG. 15 for explaining the operation of the fourth embodiment.
Figure 17D:
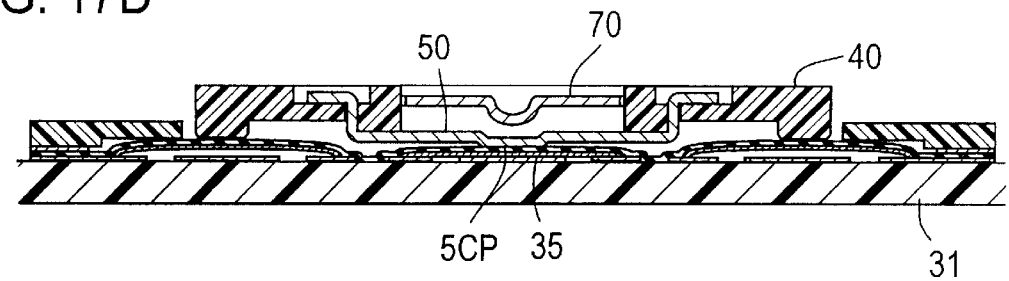
FIG. 17D is a sectional view taken along the line 17—17 in FIG. 15 for explaining the operation of the fourth embodiment.

FIG. 17A is a sectional view of the four-direction switch taken along the line 17—17 in FIG. 15 in its open state with the keytop 40 is not being pressed. Upon the keytop 40 being pressed at its left-hand edge, the keytop 40 pivots about the fulcrum portion 71P of the frame 70, causing the press protrusion 4PP on the underside of the keytop 40 to press the corresponding peripheral movable contact 36 into contact with the underlying peripheral stationary contact 33 as shown in FIG. 17B. At this time, no substantial pressure is applied to the central movable contact 35. FIG. 17 shows the case where the keytop 40 is pressed at its right-hand edge. FIG. 17D shows the case where the keytop 40 is pressed at the center thereof. Since the frame 70 is fixed to the printed wiring board 31, the pusher 50 disengages from the frame 70 and the press protrusion 5CP presses the central movable contact 35 into contact with the central stationary contact 32.

The central and peripheral movable contacts formed in one-piece structure in the first embodiment may be substituted with independent movable contacts used in the second, third and fourth embodiments; conversely, the independent movable contacts in the second, third and fourth embodiments may also be replaced with the movable contacts formed as a unitary structure in the first embodiment.

While in the above the present invention has been described as being applied to the four-direction switch with a center click, the invention is not limited specifically thereto but is applicable as well to an eight-direction switch with a center click, for instance.

Effect of the Invention

Figure 1A:
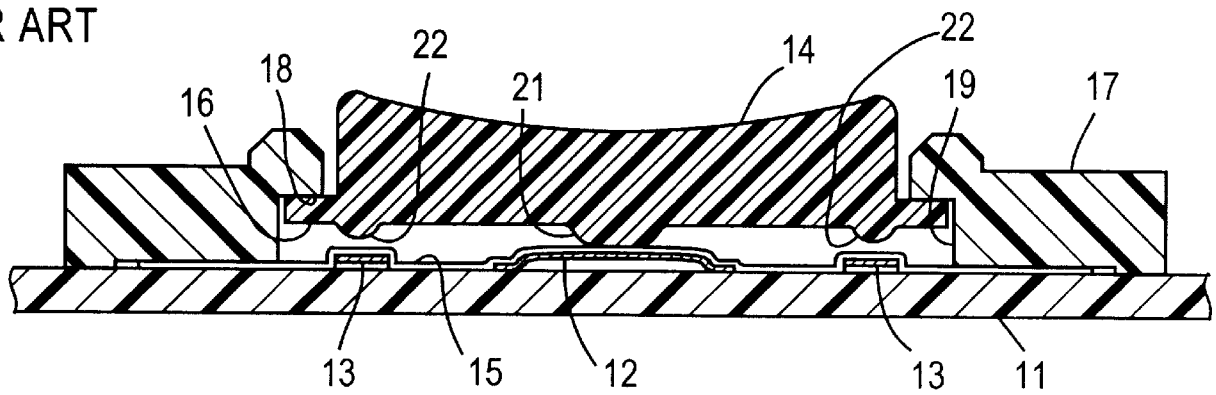
FIG. 1A PRIOR ART
FIG. 1A is a sectional view for explaining the operation of a conventional multi-direction switch.
Figure 1B:
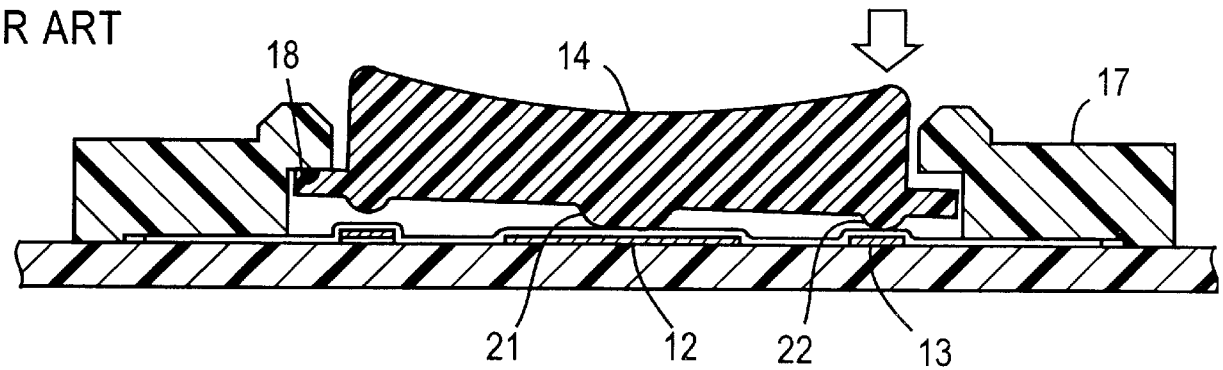
FIG. 1B PRIOR ART
FIG. 1B is a sectional view taken along a line spaced 45° apart from that in FIG. 1A.

As described above, according to the present invention, the central plate portion 71 of the frame 70 having its legs fixed to the printed wiring board 31 is received in the gap 4G defined by the underside of the keytop 40 and the pusher 50 having its arms 52 fixed thereto, and the keytop 40 pivots about the fulcrum portion 71P of the frame 70 at the center thereof. In the conventional multi-direction switch of FIG. 1, when depressed at its marginal edge, the keytop 14 pivots about the flange 18 of the housing 17 contacting the marginal edge diametrically opposite the point of depression, but in the present invention the keytop 40 does not perform such pivotal motion. Hence, the central movable contact and one of the peripheral movable contacts are not readily turned ON at the same time.

It will be apparent that many modifications and variations may be effected without departing from the scope of the novel concepts of the present invention.

What is claimed is:

1. A multi-direction switch which is provided with a central switch and a plurality of peripheral switches arranged about said central switch and in which a desired one of said switches is actuated by pressing a keytop, said multi-direction switch comprising:

a printed wiring board having formed thereon a central stationary contact and a plurality of peripheral stationary contacts arranged circumferentially about said central stationary contact;

a dome-shaped central movable contact disposed above said central stationary contact and constituting said central switch together with said central stationary contact;

peripheral movable contacts each disposed above one of said peripheral stationary contacts and constituting one of said plurality of peripheral switches together with the corresponding one of said plurality of peripheral stationary contacts;

a frame having a central plate portion disposed above said central movable contact, a plurality of legs bent from a periphery of said central plate portion toward said printed wiring board, and a fulcrum portion provided on an underside of said central plate portion, said frame being fixed to said printed wiring board;

a keytop disposed above said frame;

a housing having an opening for receiving said keytop and fixed to said printed wiring board; and a pusher having a base opposed to an underside of said keytop with said central plate portion of said frame sandwiched therebetween, a plurality of arms extended radially from said base and fixed to the underside of said keytop, an engagement portion formed in a top surface of said base centrally thereof for pivotable engagement with said fulcrum portion of said frame, and a central press protrusion provided on an underside of said base centrally thereof opposite said central movable contact;

wherein the top surface of said base of said pusher and the bottom surface of said keytop define therebetween a gap for receiving said central plate portion of said frame in a manner to permit pivotal movement of said keytop.

2. The multi-direction switch of claim 1, wherein said pusher has a peripheral press protrusion provided on an underside of each of said plurality of arms in opposing relation to one of said plurality of peripheral movable contacts.

3. The multi-direction switch of claim 2, wherein: a plurality of retaining pieces are protrusively provided on an inner peripheral surface of said opening of said housing; said plurality of legs of said frame are bent outwardly in L-letter form; and said plurality of legs of said frame have tip ends that are fixedly held between said plurality of retaining pieces and said printed wiring board.

4. The multi-direction switch of claim 3, wherein said pusher is molded of a synthetic resin material.

5. The multi-direction switch of claim 2, wherein when said keytop is not pressed, said central movable contact is in resilient contact with said central press protrusion and said fulcrum portion is in resilient contact with said engagement portion.

6. The multi-direction switch of claim 1, wherein said keytop has peripheral press protrusions provided on the underside thereof in opposing relation to said peripheral movable contacts.

7. The multi-direction switch of claim 6, wherein when said keytop is not pressed, said central movable contact is in resilient contact with said central press protrusion and said fulcrum portion is in resilient contact with said engagement portion.

8. The multi-direction switch of claim 6, wherein: a mounting plate, which has cut therethrough a slit centrally thereof for receiving said base of said pusher and has secured thereto said central plate portion of said frame across said slit by said plurality of legs of said frame, is held between said housing and said printed wiring board; and said peripheral press protrusions provided on the underside of said keytop are disposed opposite said peripheral movable contacts through said slit of said mounting plate.

9. The multi-direction switch of claim 4, wherein an elastic sheet, which has an opening bored therethrough centrally thereof for receiving said pusher and an annular ridge formed along a marginal edge of said opening, is held between said housing and said printed wiring board with said annular ridge fitted in an annular groove cut in the underside of said keytop.

10. The multi-direction switch of claim 9, wherein a keytop sheet extending from an outer periphery of said keytop and formed integrally therewith is held between said housing and said elastic sheet.

11. The multi-direction switch of claim 4, wherein there are provided a mounting plate which has an annular portion and a plurality of frame support protrusions protruding from an inner marginal edge of said annular portion toward a center thereof for supporting said base of said frame disposed at a center of said mounting plate with said plurality of legs of said frame fixed to said plurality of frame support protrusions, and a double-sided adhesive sheet having its central portion cut out for bonding said annular portion of said mounting plate to said printed wiring board, said peripheral press protrusion of said keytop and said pusher lying in said cut-out central portion of said double-sided adhesive sheet.

12. The multi-direction switch of claim 11, wherein said keytop has an annular portion and a plurality of pusher support protrusion protruding from the inner marginal edge of said annular portion toward the center thereof, and said pusher is fixed to said pusher support protrusions of said keytop with said central plate portion of said frame held between said arms of said pusher.

13. The multi-direction switch of any one of claims 2, 4, 6, 8, 9 and 11, wherein said frame is made from sheet metal.

14. The multi-direction switch of any one of claims 2, 4, 6, 8, 9 and 11, wherein each of said peripheral movable contacts is disposed above said printed wiring board with the corresponding peripheral stationary contact interposed between both ends of said each peripheral movable contact, said each peripheral movable contact being held opposite said corresponding peripheral stationary contact with a predetermined gap defined between them.

15. The multi-direction switch of any one of claims 2, 4, 6, 8, 9 and 11, wherein said central movable contact and said peripheral movable contacts are formed in one-piece of resilient sheet metal.

16. The multi-direction switch of any one of claims 2, 4, 6, 8, 9 and 11, wherein when said keytop is not pressed, said each peripheral movable contact abuts against a corresponding one of said peripheral press protrusions.

17. The multi-direction switch of any one of claims 2, 4, 6, 8, 9 and 11, wherein said fulcrum portion of said frame is a protrusion and said engagement portion is a recess.

18. The multi-direction switch of any one of claims 2, 4, 6, 8, 9 and 11, wherein said peripheral stationary contacts are each formed by a pair of opposed electrodes.

19. The multi-direction switch of any one of claims 2, 4, 6, 8, 9 and 11, wherein the numbers of said peripheral stationary contacts, said arms of said pusher and said legs of said frame are all four.

20. The multi-direction switch of any one of claims 2, 4, 6, 8, 9 and 11, wherein a single-sided adhesive sheet is pasted from above to said printed wiring board over the entire area of its top surface including said central movable contact and said peripheral movable contacts, and said central and peripheral movable contacts are thereby positioned and fixed, said pusher being held on said single-sided adhesive sheet.

21. The multi-direction switch of any one of claims 2, 4, 6, 8, 9 and 11, wherein said pusher is made from sheet metal.

22. The multi-direction switch of any one of claims 2, 4, 6, 8, 9 and 11, wherein said printed wiring board is a printed wiring board on which there are printed said central stationary contact and said peripheral stationary contacts and leads connected thereto.

23. The multi-direction switch of any one of claims 2, 4, 6, 8, 9 and 11, wherein said printed wiring board is composed of a substrate and a printed wiring sheet on which there are printed said central stationary contacts and said peripheral stationary contacts, said printed wiring board being bonded to said substrate.

24. The multi-direction switch of any one of claims 2, 4, 6, 8, 9 and 11, wherein there are protrusively provided bosses on the underside of said keytop at positions corresponding to those circumferentially intermediate between adjacent peripheral switches regularly spaced about said central switch.

25. The multi-direction switch of any one of claims 2, 4, 6, 8, 9 and 11, wherein a keytop sheet extending from the outer periphery of said keytop and formed integrally therewith is held between said housing and said printed wiring board.

26. The multi-direction switch of any one of claims 2, 4, 6, 8, 9 and 11, wherein a projecting end of said press protrusion of said pusher is flat.

* * * * *